US009079081B2

(12) United States Patent
Shimazaki

(10) Patent No.: US 9,079,081 B2
(45) Date of Patent: Jul. 14, 2015

(54) IRON HEAD

(75) Inventor: Hideo Shimazaki, Tokyo (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 403 days.

(21) Appl. No.: 13/443,369

(22) Filed: Apr. 10, 2012

(65) Prior Publication Data

US 2012/0196702 A1 Aug. 2, 2012

Related U.S. Application Data

(63) Continuation-in-part of application No. 12/507,266, filed on Jul. 22, 2009, now Pat. No. 8,277,337.

(51) Int. Cl.

| | |
|---|---|
| ***A63B 53/04*** | (2006.01) |
| ***A63B 53/06*** | (2006.01) |
| *A63B 59/00* | (2015.01) |

(52) U.S. Cl.

CPC ..... *A63B 53/047* (2013.01); *A63B 53/0475* (2013.01); *A63B 59/0092* (2013.01); *A63B 2053/0408* (2013.01); *A63B 2053/0433* (2013.01); *A63B 2053/0454* (2013.01); *A63B 2053/0491* (2013.01)

(58) Field of Classification Search

USPC ..... 473/324–350

See application file for complete search history.

(56) References Cited

U.S. PATENT DOCUMENTS

| | | | |
|---|---|---|---|
| 2,846,288 | A | 8/1958 | Fryklund |
| 3,556,532 | A | 1/1971 | Ballmer |
| 3,862,759 | A | 1/1975 | Evans et al. |
| 4,340,230 | A | 7/1982 | Churchward |
| 4,398,965 | A | 8/1983 | Campau |
| 4,809,982 | A | 3/1989 | Kobayashi |
| 4,928,972 | A | 5/1990 | Nakanishi et al. |
| 5,048,835 | A | 9/1991 | Gorman |
| 5,050,879 | A | 9/1991 | Sun et al. |
| 5,282,625 | A | 2/1994 | Schmidt et al. |
| 5,301,946 | A | 4/1994 | Schmidt et al. |
| 5,437,456 | A | 8/1995 | Schmidt et al. |
| 5,492,327 | A | 2/1996 | Biafore, Jr. |
| 5,586,947 | A | 12/1996 | Hutin |

(Continued)

FOREIGN PATENT DOCUMENTS

| | | | |
|---|---|---|---|
| JP | S51-116057 | U | 9/1976 |
| JP | 57-188271 | A | 11/1982 |

(Continued)

OTHER PUBLICATIONS

Notice of Rejection for JP Patent Application 2009-257163, Jul. 23, 2013, Japan Patent Office.

*Primary Examiner* — Alvin Hunter

(74) *Attorney, Agent, or Firm* — Kubotera & Associates LLC

(57) ABSTRACT

An iron head includes a striking face; a backside surface; a sole surface; a hosel; a recess portion provided in an upper portion of the backside surface; a protruding portion provided at a lower portion of the backside surface and projecting backward; a first hollow portion provided on a heel side of the protruding portion; and a second hollow portion disposed on a toe side and inside the protruding portion. The protruding portion includes a middle portion between the first hollow portion and the second hollow portion. The first hollow portion is disposed away from the second hollow portion by a distance gradually increasing from an upper surface of the protruding portion toward the sole surface.

16 Claims, 27 Drawing Sheets

(56) References Cited

U.S. PATENT DOCUMENTS

| | | | | |
|---|---|---|---|---|
| 5,588,922 | A | 12/1996 | Schmidt et al. | |
| 5,595,552 | A | 1/1997 | Wright et al. | |
| 5,605,511 | A | 2/1997 | Schmidt et al. | |
| 5,722,900 | A | 3/1998 | Sung | |
| 5,766,092 | A | 6/1998 | Mimeur et al. | |
| 6,045,456 | A | 4/2000 | Best et al. | |
| 6,086,485 | A | 7/2000 | Hamada et al. | |
| 6,344,001 | B1 | 2/2002 | Hamada et al. | |
| 6,368,232 | B1 | 4/2002 | Hamada et al. | |
| 6,551,200 | B1 | 4/2003 | Golden et al. | |
| 6,554,719 | B2 | 4/2003 | Peters et al. | |
| 6,616,547 | B2 | 9/2003 | Vincent et al. | |
| 6,638,183 | B2 | 10/2003 | Takeda | |
| 6,719,642 | B2 | 4/2004 | Wahl et al. | |
| 6,780,123 | B2 | 8/2004 | Hasebe | |
| 6,811,496 | B2 | 11/2004 | Wahl et al. | |
| 6,835,144 | B2 | 12/2004 | Best | |
| 6,846,246 | B2 | 1/2005 | Asplund et al. | |
| 6,855,066 | B2 | 2/2005 | Best | |
| 6,855,069 | B2 | 2/2005 | Nagai et al. | |
| 6,872,153 | B2 | 3/2005 | Gilbert et al. | |
| 6,902,495 | B2 | 6/2005 | Pergande et al. | |
| 6,962,538 | B2 | 11/2005 | Roach et al. | |
| 6,976,924 | B2 | 12/2005 | Gilbert et al. | |
| 6,984,180 | B2 | 1/2006 | Hasebe | |
| 6,997,820 | B2 | 2/2006 | Willett et al. | |
| 7,022,028 | B2 | 4/2006 | Nagai et al. | |
| 7,070,513 | B2 | 7/2006 | Takeda et al. | |
| 7,131,913 | B2 | 11/2006 | Iwata et al. | |
| 7,153,222 | B2 | 12/2006 | Gilbert et al. | |
| 7,166,042 | B2 | 1/2007 | Gilbert et al. | |
| 7,182,698 | B2 | 2/2007 | Tseng | |
| 7,192,362 | B2 | 3/2007 | Gilbert et al. | |
| 7,207,899 | B2 | 4/2007 | Imamoto | |
| 7,232,377 | B2 | 6/2007 | Gilbert et al. | |
| 7,232,381 | B2 | 6/2007 | Imamoto et al. | |
| 7,235,023 | B2 | 6/2007 | Sugimoto | |
| 7,238,119 | B2 | 7/2007 | Roach et al. | |
| 7,273,418 | B2 | 9/2007 | Gilbert et al. | |
| 7,281,988 | B2 | 10/2007 | Hou | |
| 7,281,989 | B2 | 10/2007 | Hou et al. | |
| 7,303,485 | B2 | 12/2007 | Tseng | |
| 7,303,486 | B2 | 12/2007 | Imamoto | |
| 7,316,623 | B2 | 1/2008 | Imamoto | |
| 7,326,127 | B2 | 2/2008 | Hou et al. | |
| 7,326,472 | B2 | 2/2008 | Shimazaki et al. | |
| 7,338,387 | B2 | 3/2008 | Nycum et al. | |
| 7,351,163 | B2 | 4/2008 | Shimazaki et al. | |
| 7,371,190 | B2 | 5/2008 | Gilbert et al. | |
| 7,393,287 | B2 | 7/2008 | Huang | |
| 7,410,427 | B2 | 8/2008 | Imamoto et al. | |
| 7,476,162 | B2 | 1/2009 | Stites et al. | |
| 7,481,717 | B2 | 1/2009 | Knuth | |
| 7,559,850 | B2 | 7/2009 | Gilbert et al. | |
| 7,575,523 | B2 | 8/2009 | Yokota | |
| 7,588,502 | B2 | 9/2009 | Nishino | |
| 7,651,413 | B1 | 1/2010 | Chen | |
| 7,670,236 | B2 * | 3/2010 | Kajita | 473/346 |
| 7,749,102 | B2 | 7/2010 | Nakamura | |
| 7,789,771 | B2 | 9/2010 | Park et al. | |
| 7,789,772 | B2 | 9/2010 | Sukman | |
| 7,972,222 | B2 * | 7/2011 | Llewellyn et al. | 473/291 |
| 8,075,419 | B2 * | 12/2011 | Sukman | 473/334 |
| 8,246,486 | B2 * | 8/2012 | Sukman | 473/329 |
| 8,277,337 | B2 * | 10/2012 | Shimazaki | 473/350 |
| 2002/0082117 | A1 | 6/2002 | Nishitani et al. | |
| 2005/0003904 | A1 | 1/2005 | Imamoto et al. | |
| 2005/0197208 | A1 | 9/2005 | Imamoto | |
| 2006/0030425 | A1 | 2/2006 | Sukman | |
| 2007/0049400 | A1 | 3/2007 | Imamoto et al. | |
| 2007/0129165 | A1 | 6/2007 | Matsunaga et al. | |
| 2007/0129166 | A1 | 6/2007 | Shimazaki et al. | |
| 2007/0129168 | A1 | 6/2007 | Matsunaga et al. | |
| 2010/0167834 | A1 * | 7/2010 | Llewellyn et al. | 473/291 |
| 2011/0021285 | A1 * | 1/2011 | Shimazaki | 473/332 |
| 2011/0028235 | A1 | 2/2011 | Nakano | |
| 2011/0159984 | A1 * | 6/2011 | Shimazaki | 473/331 |

FOREIGN PATENT DOCUMENTS

| | | | |
|---|---|---|---|
| JP | 04-227285 | | 8/1992 |
| JP | 06-319836 | | 11/1994 |
| JP | 06-343722 | | 12/1994 |
| JP | 07-213656 | | 8/1995 |
| JP | 07-265473 | A | 10/1995 |
| JP | 08-000776 | | 1/1996 |
| JP | 08-000776 | A | 1/1996 |
| JP | 09-117537 | | 5/1997 |
| JP | H09-173514 | A | 7/1997 |
| JP | 09-215795 | | 8/1997 |
| JP | 11-004922 | A | 1/1999 |
| JP | 11-178961 | | 7/1999 |
| JP | 2000-157653 | | 6/2000 |
| JP | 2000-210400 | | 8/2000 |
| JP | 2001-029521 | | 2/2001 |
| JP | 2002-65913 | A | 3/2002 |
| JP | 2004-089434 | | 3/2004 |
| JP | 2004-283318 | A | 10/2004 |
| JP | 2005-245519 | A | 9/2005 |
| JP | 2007-181616 | A | 7/2007 |
| JP | 2008-093010 | | 4/2008 |
| JP | 2010-017475 | | 1/2010 |
| JP | 2010-029544 | A | 2/2010 |
| JP | 2011-030591 | A | 2/2011 |
| WO | 02-32514 | A1 | 4/2002 |

* cited by examiner

IRON HEAD

CROSS-REFERENCE TO RELATED APPLICATIONS

This is a continuation-in-part application of a prior application Ser. No. 12/507,266, filed Jul. 22, 2009, now U.S. Pat. No. 8,277,337.

BACKGROUND OF THE INVENTION AND RELATED ART STATEMENT

The present invention relates to an iron head for an iron type golf club. More particularly, the present invention relates to an iron head having a hollow portion.

An iron type golf club includes a shaft and an iron head disposed at a distal end of the shaft, so that a striking face of the iron head hits a ball. The shaft is inserted and fixed into a hosel formed in the iron head. A side of the iron head where the hosel is formed is referred to as a heel, and an opposite side of the iron head, i.e., a distal end side thereof, is referred as a toe. A bottom side of the iron head facing a ground surface is referred to as a sole. A plurality of grooves, i.e., score lines, is formed in the striking face of the iron head with a certain distance therebetween in a vertical direction.

Patent Reference 1 has disclosed a conventional iron head. The conventional iron head has a recess portion disposed at an upper portion of a back surface thereof, and a hollow portion is disposed behind the striking face below the recess portion. With the hollow portion formed in the iron head, it is possible to lower the center of gravity of the iron head. Further, the center of gravity is shifted backward from the striking face of the iron head, thereby expanding a sweet area thereof. In addition, when the hollow portion is formed in the iron head, a weight of the iron head is reduced. Therefore it is possible to increase a size of the iron head without increasing the weight thereof. Further, when a weight distribution increases on the toe side and the heel side of the iron head, it is possible to increase the sweet area of the iron head without increasing the weight thereof.

In Patent Reference 1, the conventional iron head has the hollow portion extending from the proximity of the toe to the proximity of the heel. A thickness of a face plate, or a distance between the striking face and the hollow portion, is substantially uniform between the toe side and the heel side.

Patent Reference 2 has disclosed another type of conventional iron heads. The conventional iron head has a hollow portion disposed behind a striking face, and a shock absorber made of a rubber, urethane, or silicone is disposed in the hollow portion. The shock absorber has a thickness about 1.5 mm to 8.0 mm.

Patent Reference 3 has disclosed a golf club having a striking face capable of bending like a wood club. With the configuration, it is possible to hit a ball for a long distance.

Patent Reference 4 has disclosed an iron head having a hollow portion and a viscoelastic body disposed in the hollow portion. The viscoelastic body enables to dampen a vibration of the iron head.

Patent Reference 5 has disclosed an iron head including a cavity portion in an upper portion of a backside surface thereof and a protruding portion in a lower portion of the backside surface thereof. The iron head further includes a hollow portion being concaved toward a sole surface side in an upper portion of the protruding portion. In Patent Reference 5, the iron head includes the hollow portions disposed in both of a heel side and a toe side thereof.

Patent Reference 1: Japanese Patent Publication No. 2000-210400

Patent Reference 2: Japanese Patent Publication No. 09-117537

Patent Reference 3: U.S. Pat. No. 4,398,965

Patent Reference 4: Japanese Patent Publication No. 06-319836

Patent Reference 5: Japanese Patent Publication No. 2010-017475

In the conventional iron head disclosed in Patent Reference 1, the thickness of the face plate between the striking face and the hollow portion, in other words, the distance between the striking face and the hollow portion, is substantially uniform in a toe to heel direction. When the golf club having the iron head hits a ball at a middle portion thereof, it is difficult to obtain a strong impact feeling due to the hollow portion formed behind the middle portion and the small thickness of the face plate at the middle portion of the iron head.

In view of the problems described above, an object of the present invention is to provide an iron head having a wide sweet area and capable of obtaining a strong impact feeling when hitting a ball at a middle portion thereof.

SUMMARY OF THE INVENTION

In order to attain the object described above, according to a first aspect of the present invention, an iron head is provided with a striking face; a backside surface; a sole surface; a hosel; a recess portion provided in an upper portion of the backside surface; a protruding portion provided at a lower portion of the backside surface and projecting backward; a first hollow portion provided on a heel side of the protruding portion; and a second hollow portion disposed on a toe side of the protruding portion. The protruding portion has a middle portion between the first hollow portion and the second hollow portion.

According to a second aspect of the present invention, in the iron head in the first aspect, at least one of the first hollow portion and the second hollow portion penetrates from an upper surface of the protruding portion to a sole surface, and has a first lid to close the sole surface.

According to a third aspect of the present invention, in the iron head in the first aspect, at least one of the first hollow portion and the second hollow portion has a second lid to close an upper portion thereof.

According to a fourth aspect of the present invention, in the iron head in the first aspect, the first hollow portion is disposed away from the second hollow portion by a distance equal to a distance between the upper surface of the protruding portion and the sole surface.

According to a fifth aspect of the present invention, in the iron head in the first aspect, the first hollow portion is disposed away from the second hollow portion by a distance of 10 to 30 mm.

According to a sixth aspect of the present invention, in the iron head in the first aspect, the first hollow portion is disposed away from the second hollow portion by a distance gradually increasing from the upper surface of the protruding portion toward the sole surface.

According to a seventh aspect of the present invention, in the iron head in the first aspect, the first hollow portion is disposed away from the second hollow portion by a distance of 10 to 30 mm at the upper surface of the protruding portion.

According to an eighth aspect of the present invention, in the iron head in the first aspect, at least one of the first hollow portion and the second hollow portion is disposed not to reach the sole surface.

According to a ninth aspect of the present invention, in the iron head in the first aspect, at least one of the first hollow portion and the second hollow portion is filled with a shock absorber.

According to a tenth aspect of the present invention, in the iron head in the ninth aspect, the shock absorber is made of a rubber or an elastomer.

According to an eleventh aspect of the present invention, an iron head is provided with a striking face; a backside surface; a sole surface; a hosel; a recess portion provided in an upper portion of the backside surface; a protruding portion provided at a lower portion of the backside surface and projecting backward; and a hollow portion extending from a toe side to a heel side of the protruding portion. The protruding portion has a middle portion with a first face plate thickness in a toe to heel direction thereof. The first face plate thickness is larger than a second face plate thickness on a toe side with respect to the middle portion and a third face plate thickness on a heel side with respect to the middle portion.

According to a twelfth aspect of the present invention, in the iron head in the eleventh aspect, the hollow portion has a length of 15 to 30 mm in from the toe side to the heel side.

According to a thirteenth aspect of the present invention, in the iron head in the eleventh aspect, the middle portion has a width of 15 to 30 mm in the toe to heel direction.

According to a fourteenth aspect of the present invention, in the iron head in the eleventh aspect, the middle portion has the first face plate thickness equal to or more than 2.5 mm. The first face plate thickness is larger than the second face plate thickness and third face plate thickness by equal to or more than 0.5 mm.

According to a fifteenth aspect of the present invention, in the iron head in the eleventh aspect, the middle portion has the first face plate thickness increasing gradually from an upper portion toward a lower portion thereof.

According to a sixteenth aspect of the present invention, in the iron head in the eleventh aspect, the hollow portion penetrates from an upper surface of the protruding portion to the sole surface, and includes a bottom surface closed with a bottom lid.

According to a seventeenth aspect of the present invention, in the iron head in the eleventh aspect, a shock absorber fills the hollow portion.

According to an eighteenth aspect of the present invention, in the iron head in the seventeenth aspect, the shock absorber is made of a rubber or an elastomer.

In the first aspect of the present invention, the iron head is provided with the first hollow portion and the second hollow portion on the toe side and the heel side of the middle portion, respectively, thereby reducing a total weight of the iron head. Accordingly, it is possible to enlarge a sweet area without increasing the total weight. Further, it is possible to increase a partial weight on the toe side and the heel side, thereby increasing the sweet area of the iron head. In the iron head in the first aspect, the hollow portion is not provided behind the middle portion. Accordingly, it is possible to obtain a strong hitting impact feeling when hitting a ball at the middle portion.

In the eleventh aspect of the present invention, the iron head is provided with the hollow portion extending from the toe side toward the heel side of the middle portion. Accordingly, it is possible to reduce the total weight of the iron head. Therefore, it is possible to increase a size of the iron head without increasing the total weight thereof. In addition, it is possible to increase a partial weight on the toe side and the heel side of the iron head without increasing the total weight of the iron head, thereby increasing the sweet area. In the iron head, the face plate has the thickness at the middle portion greater than that of the toe side and the heel side. Accordingly, it is possible to obtain a strong hitting impact feeling when hitting a ball at the middle portion.

DETAILED DESCRIPTION OF PREFERRED EMBODIMENTS

First Embodiment

Figure 1:
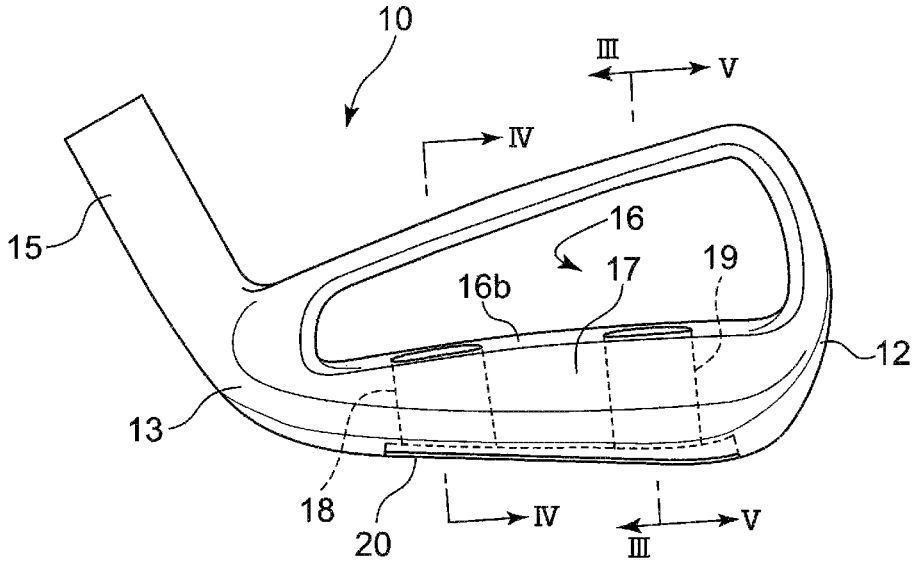
FIG. 1 is a rear view of an iron head according to a first embodiment of the present invention.

FIGS. 1 through 6 show an iron head 10 according to a first embodiment of the present invention. The iron head 10 is provided with a striking face 11 for hitting a ball, a toe side 12, a heel side 13, a sole surface 14, and a hosel 15 for connecting a shaft. Further, the iron head 10 is provided with a cavity portion 16 disposed in an upper portion of a backside surface thereof; a protruding portion 17 disposed at a lower portion of the backside surface thereof and projecting backward; a first hollow portion 18 disposed on the heel side 13 of the protruding portion 17 and penetrating from a bottom surface 16*b* of the cavity portion 16 to the sole surface 14; a second hollow portion 19 disposed on the toe side of the protruding portion 17; and a bottom lid 20 disposed on the sole surface to close the hollow portions 18 and 19.

Figure 2:
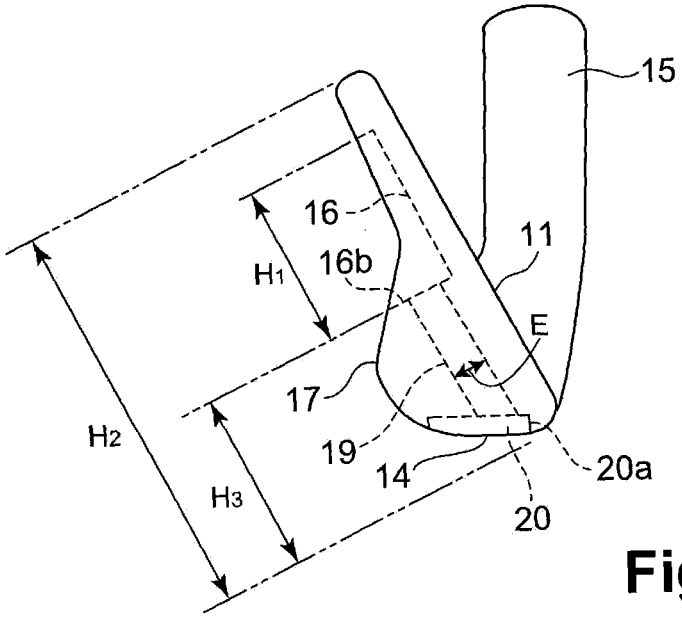
FIG. 2 is a side view of the iron head viewed from a toe side thereof according to the first embodiment of the present invention.
Figure 3:
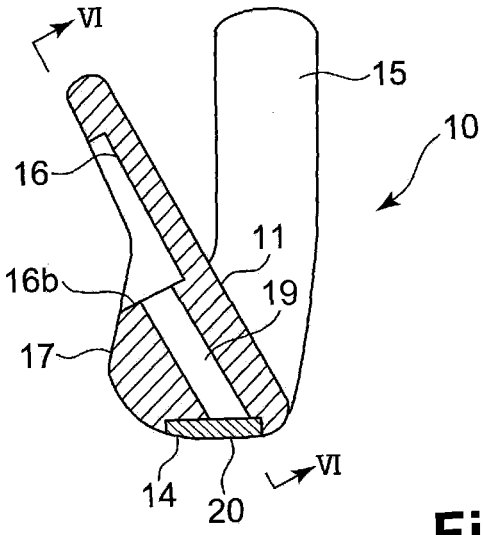
FIG. 3 is a sectional view of the iron head taken along a line III-III in FIG. 1 according to the first embodiment of the present invention.
Figure 6:
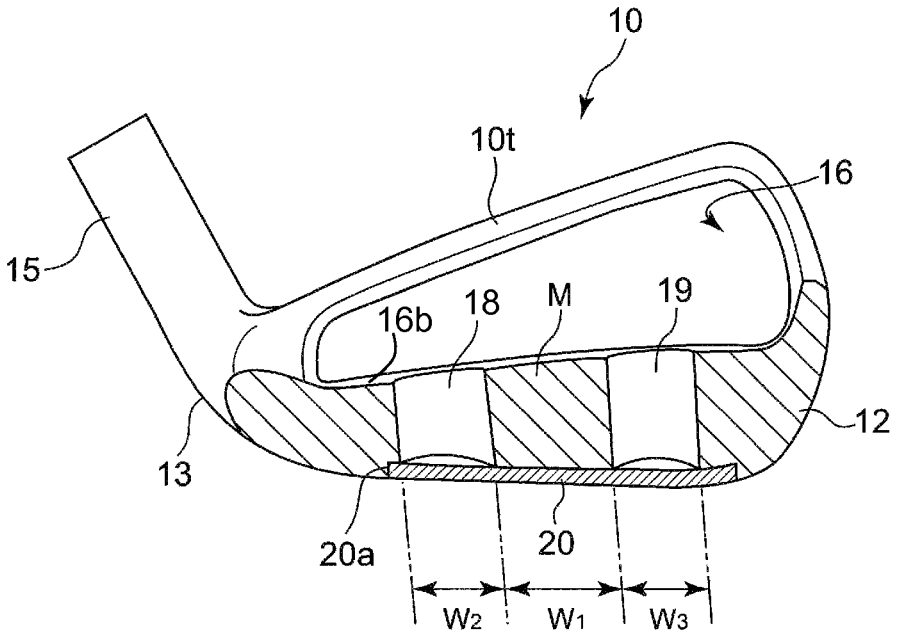
FIG. 6 is a sectional view of the iron head taken along a line VI-VI in FIG. 3 according to the first embodiment of the present invention.

As shown in FIG. 6, the cavity portion 16 is recessed from a rear side of the iron head to the striking surface side thereof not only at an upper edge 10*t* of the cavity portion 16 but also at both the toe side 12 and the heel side 13. The cavity portion 16 extends from the toe side 12 to the heel side 13. It is desirable that a thickness of a face plate at the cavity portion 16 is between 1.5 mm and 3.5 mm, especially between 2 mm and 3 mm. As shown in FIG. 2, the cavity portion 16 has a maximum length H1 in a direction parallel to the striking face 11 at proximity of the toe side 12. Further, the striking face 11 has a maximum length H2 in a vertical direction. It is desirable that the maximum length H1 is 20% to 50%, especially 25% to 40%, of the maximum length H2.

The protruding portion 17 projects backward at a lower portion of the cavity portion 16. The protruding portion 17 has the upper surface 16*b* which is substantially perpendicular to the striking face 11. As shown in FIG. 2, the protruding portion 17 has a maximum length H3 at the proximity of the toe side 12 in the top to bottom direction of the iron head and in a direction parallel to the striking face 11. It is desirable that H3 is 48% to 78%, especially 58% to 73%, of the maximum length H2 of the striking face in the vertical direction. A same ratio is applied to a desirable ratio between a maximum length of the heel side 13 in the top to bottom direction of the iron head and in the direction parallel to the striking face 11 and a maximum length of the striking face 11 in the top to bottom direction.

The hollow portions 18 and 19 penetrate from the upper surface 16*b* of the protruding portion 17 to the sole surface 14. In the embodiment, the hollow portions 18 and 19 have a width, in a toe to heel direction, being substantially same anywhere from an upper end thereof to a lower end thereof. Further, as shown in FIG. 2, the hollow portions 18 and 19 have a thickness E, a width in the direction perpendicular to the striking face 11. The thickness E is substantially same anywhere from the upper end of the hollow portions 18 and 19 to the lower end thereof.

As shown in FIG. 6, the hollow portion 18 has a width W2, in the toe to heel direction, equal to or more than 10 mm but does not extend over the edge of the cavity portion 16 on the heel side, more preferably, between 15 mm and 20 mm. The hollow portion 19 has a width W3, in the toe to heel direction, equal to or more than 10 mm but does not extend over the edge of the cavity portion 16 on the heel side, more preferably, between the 15 mm and 20 mm. A middle portion M between the hollow portions 18 and 19 corresponds to a sweet area situated at the lower portion of the center part of the striking face 11. The middle portion M is not a hollow portion and is made of a metal material such as iron and an iron-base alloy, which are also used to produce the iron head 10.

As shown in FIG. 6, in the embodiment, the middle portion M has the width W1, in the toe to heel direction, which is substantially same from the upper end thereof to the lower end thereof. It is desirable that the width W1 has a width equal to or more than 10 mm but does not extend over the edge of the cavity portion 16 on the toe side, more preferably, between equal to or more than 15 mm and equal to or less than 20 mm.

The hollow portions 18 and 19 have bottom ends closed by the bottom lid 20. As shown in FIGS. 2 and 6, the bottom lid 20 is fitted into a recess portion 20*a* provided in the sole surface, and fixed thereto by crimping, welding such as a laser welding, shrink fitting, and cooling fitting.

Figure 4:
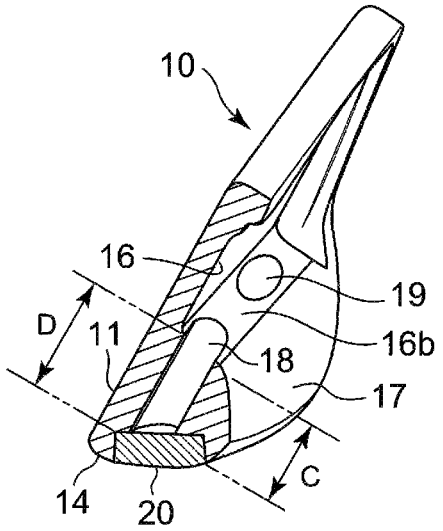
FIG. 4 is a sectional view of the iron head taken along a line IV-IV in FIG. 1 according to the first embodiment of the present invention.
Figure 5:
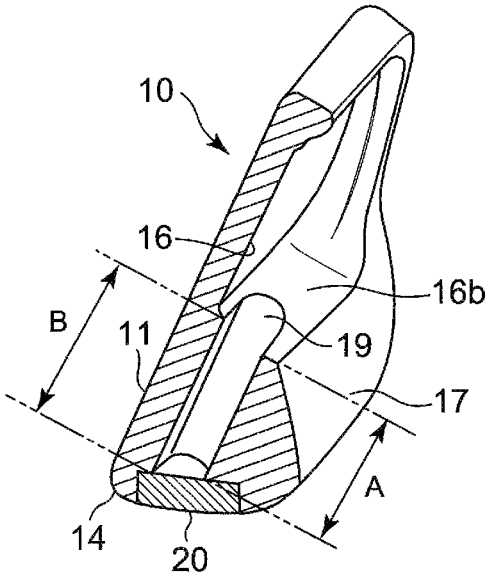
FIG. 5 is a sectional view of the iron head taken along a line V-V in FIG. 1 according to the first embodiment of the present invention.

As shown in FIG. 5, a depth A is a depth of the hollow portion 19 on the backside surface side of the iron head, and a depth B is a depth of the hollow portion 19 on the striking face 11 side thereof. As shown in FIG. 4, a depth C is a depth of the hollow portion 18 on the backside surface side thereof and a depth D is a depth of the hollow portion 19 on the striking face 11 side thereof. Examples of A, B, C, D are shown in a table below for each of iron golf clubs No. 3 through No. 9 and a pitching wedge.

| | A | B | C | D |
|---|---|---|---|---|
| #3 | 14.6 | 17.1 | 9.3 | 11.8 |
| #4 | 15.3 | 18.2 | 9.7 | 12.6 |
| #5 | 15.8 | 19 | 9.8 | 13 |
| #6 | 16.1 | 19.7 | 10.2 | 13.7 |
| #7 | 16.9 | 20.8 | 10.7 | 14.6 |
| #8 | 17.9 | 21.8 | 11.4 | 15.3 |
| #9 | 18.5 | 23 | 12.1 | 16.6 |
| PW | 18.8 | 23.2 | 12.7 | 17.1 |

In this configuration, the iron head 10 has the hollow portion 18 and the hollow portion 19 located closer to the toe side 12 or the heel side 13 respectively outside of the middle portion M thereof. With the hollow portions 18 and 19 formed in the iron head, it is possible to reduce the weight of the iron head. Therefore, it is possible to increase a size of the iron head 10 without increasing the total weight thereof. Further, when a weight distribution increases on the toe side and the heel side of the iron head, it is possible to increase a sweet area of the iron head 10 without increasing the total weight thereof. Because the middle portion M is provided with no hollow portion, the iron head 10 in this configuration is capable of providing strong impact feeling when hitting a ball.

As examples of iron or an iron-base alloy used to produce the iron head 10, there are stainless such as SUS630, 303 and 304; low-carbon steel such as S20C, S15C, and S25C; and maraging steel. A specific gravity of these materials is about 7.8 to 8.2. The iron head may be produced by either forging or casting.

The bottom lid 20 may be made of either the iron or the iron-base alloy mentioned above, but a metal or an alloyed metal, which has a larger specific gravity, is more desirable as it is capable of lowering the center of gravity of the iron head. As such metal or alloyed metal, tungsten alloy is suitable as a specific gravity thereof is 10 to 15. More specifically, tungsten-nickel alloy, tungsten-copper alloy, and tungsten-iron alloy, for example, may be used.

Second Embodiment

Figure 7:
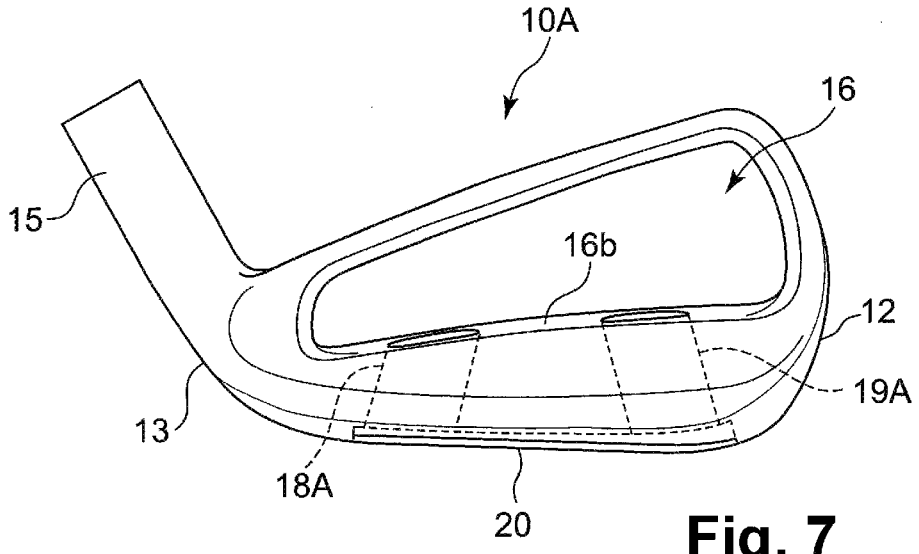
FIG. 7 is a rear view of an iron head according to a second embodiment of the present invention.
Figure 8:
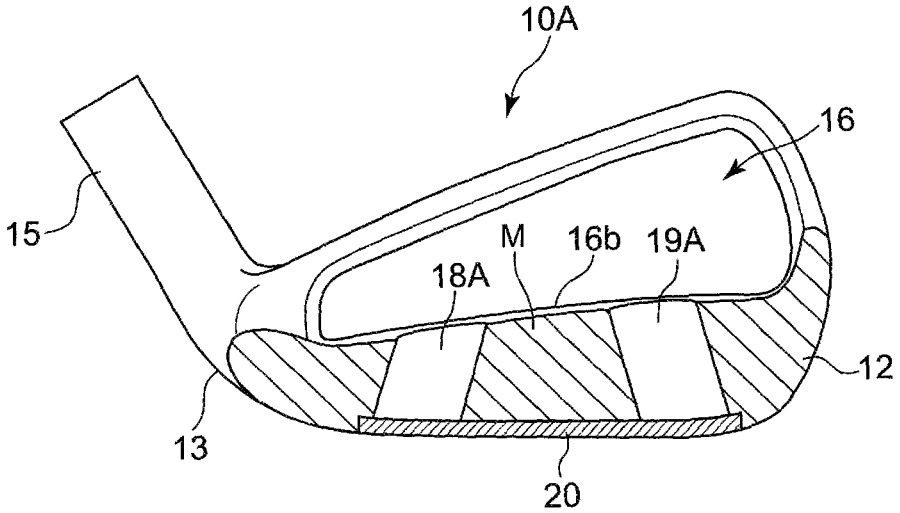
FIG. 8 is a sectional view of the iron head according to the second embodiment of the present invention.

FIGS. 7 and 8 show an iron head 10A according to the second embodiment of the present invention. According to the first embodiment, the width W1 of the middle portion M in the toe to heel direction is substantially same from the upper end thereof to the lower end thereof. According to the second embodiment, instead of the hollow portions 18 and 19 in the first embodiment, the iron head 10A is provided with a hollow portion 18A disposed away from a hollow portion 19A by a distance gradually increasing from the upper surface of the protruding portion toward the sole surface.

It is desirable that the hollow portion 18A and the hollow portion 19A have a distance therebetween, at the top end thereof, being same as the width W1 mentioned above. Further, at the bottom end, it is desirable that the distance between the hollow portion 18A and the hollow portion 19A is equal to or less than 1.2 times, especially equal to or less than 1.1 times, of the distance between the hollow portion 18A and the hollow portion 19A at the top end thereof. Other configurations of the iron head 10A are same as the first embodiment, and same reference numerals denote same components.

Third Embodiment

Figure 9:
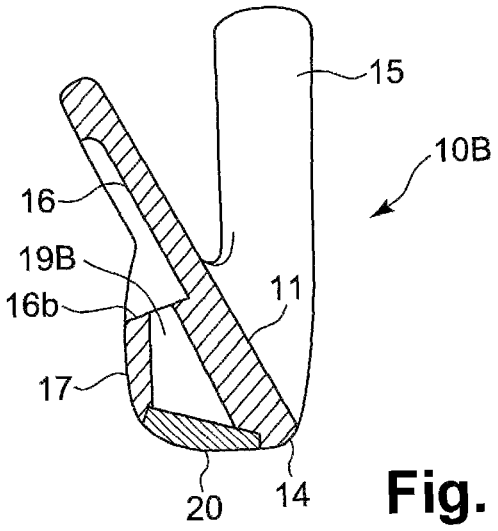
FIG. 9 is a sectional view of an iron head according to a third embodiment of the present invention.

In the first and second embodiments, the hollow portions 18, 19, 18A, and 19A have a width E, which is the thickness thereof in the vertical direction to the face surface. The width E is substantially same from the top end to the bottom end of the hollow portions 18, 19, 18A, and 19A. As shown in FIG. 9, in an iron head 10B according to the third embodiment, each of hollow portions 18B (not shown) and 19B has a thickness gradually increasing from the top end of the hollow portions toward the bottom end thereof. Further, the hollow portions 18B and 19B have a thickness, at the upper end thereof, being same as the width E in the first and second embodiments. It is desirable that the thickness of the bottom end of the hollow portions 18B and 19B is equal to or less than twice, especially equal to or less than 1.2 times, of that of the upper end thereof. Other configurations of the third embodiment are same as the first embodiment, and same reference numerals denote same components.

Fourth Embodiment

Figure 10:
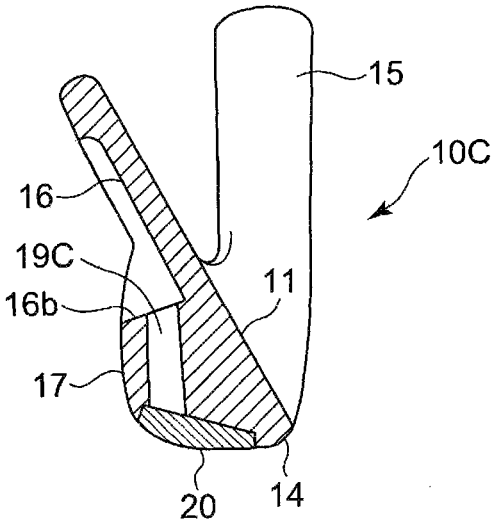
FIG. 10 is a sectional view of an iron head according to a fourth embodiment of the present invention.

In the first and second embodiment, the hollow portions 18, 19, 18A, and 19A extend from the upper surface 16*b* of the protruding portion to the sole surface 14 in a parallel direction to the striking face 11. The distance between the hollow portions and the striking face 11, i.e., the thickness of the face plate, is substantially same from the top to the bottom thereof. As shown in FIG. 10, according to the fourth embodiment, an iron head 10C has a thickness of a face plate between hollow portions 18C (not shown) and 19C and the striking face 11 being gradually increasing from the top to the bottom thereof. Other configurations of the fourth embodiment are same as the first embodiment, and same reference numerals denote same components.

Further, in the first to fourth embodiments described above, the hollow portions 18, 19, 18A, 19A, 18B, 19B, 18C, and 19C are opened to the cavity portion 16, and lids (not shown) may be fixed to the upper ends of the hollow portions. A same type of the lid may be used as those in other embodiments described later.

In the first to fourth embodiments described above, each of hollow portions penetrates from the cavity portion 16 to the sole surface, but the hollow portions may be made of holes starting from the cavity portion 16 toward the sole surface but not reaching it. Lids may be fixed at openings of the hollow portions opened to the cavity portion 16. Further, the hollow portions may be made of holes starting from the sole surface toward the cavity portion 16 but not reaching it. In this case, a bottom lid, as described in the first to fourth embodiments, is fixed to the entrance opened at the sole surface.

Fifth Embodiment

Figure 11:
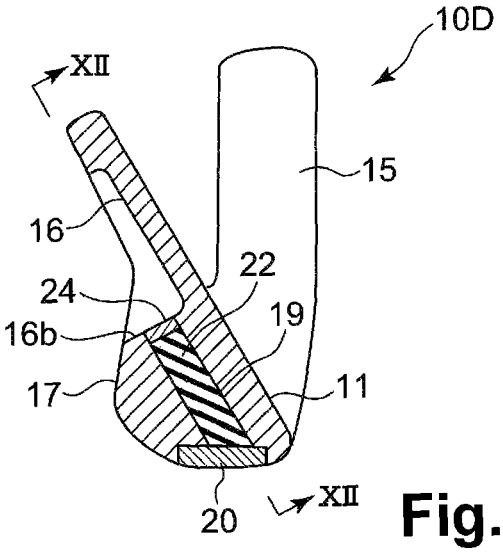
FIG. 11 is a sectional view of an iron head according to a fifth embodiment of the present invention.
Figure 12:
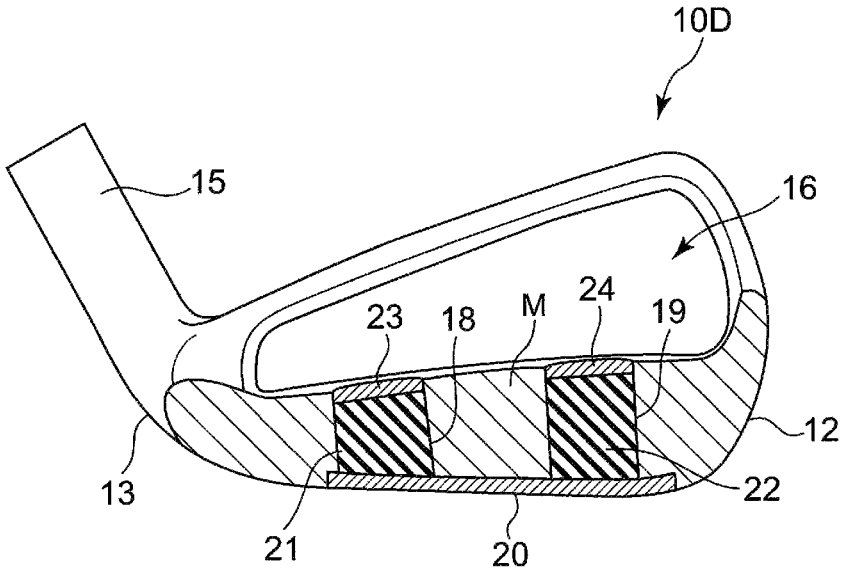
FIG. 12 is a sectional view of the iron head taken along a line XII-XII in FIG. 11 according to the fifth embodiment of the present invention.

As shown in FIGS. 11 and 12, according to the fifth embodiment, in the iron head in the first embodiment, an iron head 10D is provided with shock absorbers 21 and 22 inserted into the hollow portions 18 and 19, and lids 23 and 24 fixed at the upper ends of the hollow portions 18 and 19. It is desirable that the shock absorbers 21 and 22 are made of an elastic material such as a rubber, an elastomer, and a foam made of those.

Further, it is desirable that the lids 23 and 24 are made of a metal, a synthetic resin, or an elastomer harder than the shock absorber. The lids 23 and 24 are fixed to the top end of the hollow portions 18 and 19 by welding, caulking, shrink fitting, cooling fitting, and bonding.

Figure 13A:
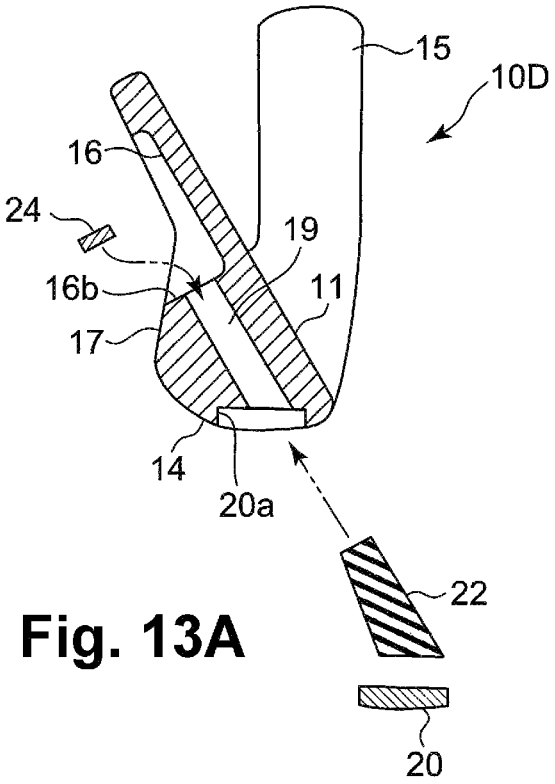
FIG. 13A is an exploded sectional view of the iron head according to the fifth embodiment of the present invention.
Figure 13B:
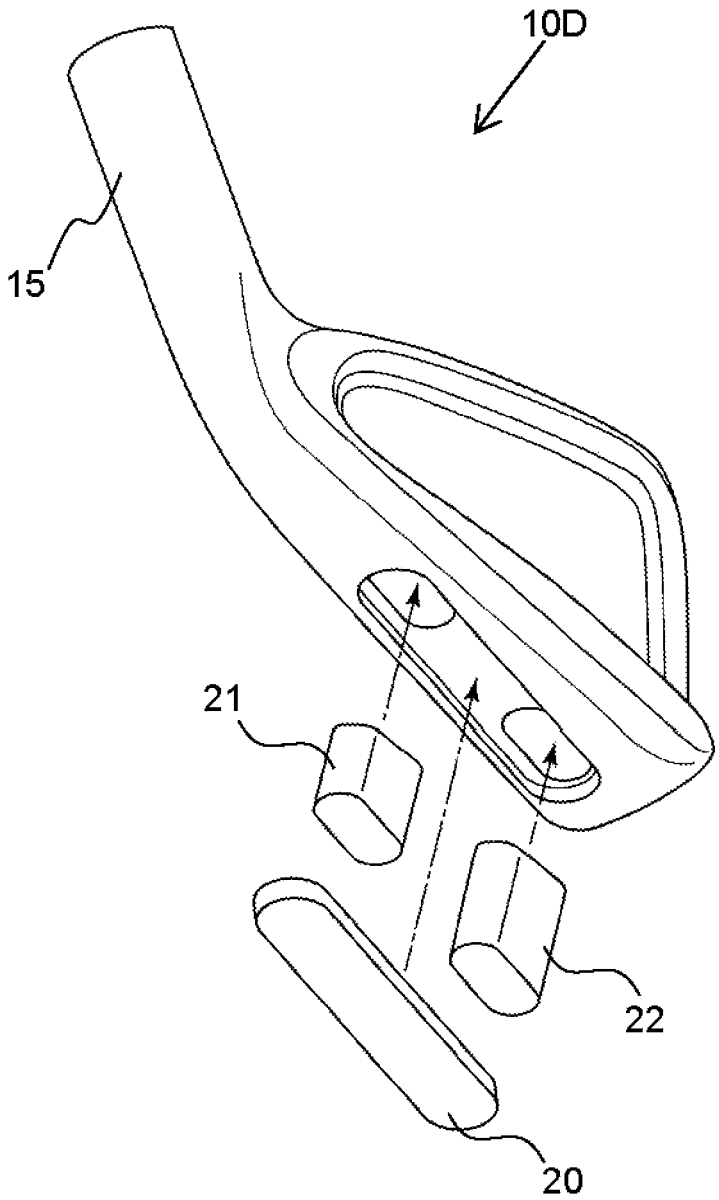
FIG. 13B is an exploded sectional view of the iron head according to the fifth embodiment of the present invention.

As shown in FIG. 13A, in the embodiment, the shock absorbers 21 and 22 have a wedge shape cross section having a thickness gradually increasing toward the bottom. As shown in FIG. 13B, the shock absorbers 21 and 22 are pushed from the sole side into the hollow portions 18 and 19, and after that, the bottom lid 20 is fixed into a recess portion 20*a* disposed in the sole surface. The upper lids 23 and 24 may be installed in the upper part of the hollow portions 18 and 19 either before or after the shock absorbers 21 and 22 are pushed into the hollow portions 18 and 19.

Before pushing the shock absorbers 21 and 22 into the hollow portions 18 and 19, an adhesive may be added to at least one of the inside wall of the hollow portions 18 and 19 or the outside wall of the shock absorbers 21 and 22.

Other configurations in FIGS. 11 to 13 are same as the first embodiment, and the same reference numerals denote same components.

Further, the hollow portions may be filled with shock absorbers which are made into a certain shape beforehand. Instead, a material having liquidity may be poured into the hollow portions and hardened to form a shock absorbent. Such materials to be used are, for example, unvulcanized or low vulcanization rubber, and an elastomer. Also, the lids may be formed by pouring a material having liquidity, such as an unvulcanized or low vulcanization rubber, or an elastomer, into the hollow portions and hardening the material instead of installing lids which are made into a certain shape beforehand. Moreover, the upper end of the hollow portion may be closed by hard materials capable of working as a lid, such as a rubber, an elastomer or a synthetic resinous material, for example, transparent acrylic acid resin. The lower part of the hollow portions may be filled with material with less hardness, such as a rubber or an elastomer. Materials with high viscosity, such as, butyl rubber and brominated butyl rubber, may be used as a shock absorber.

Sixth Embodiment

Figure 14:
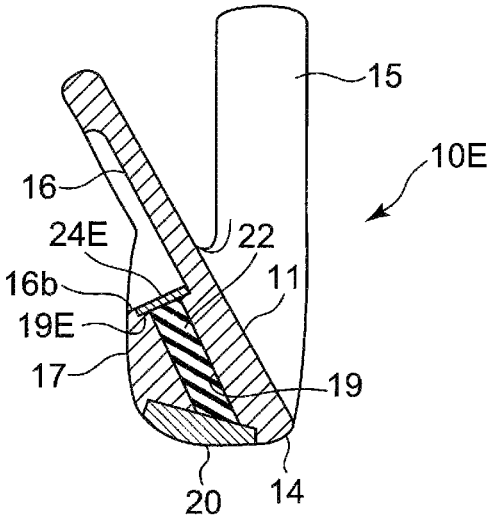
FIG. 14 is a sectional view of an iron head according to a sixth embodiment of the present invention.

In the fifth embodiment, the lids 23 and 24 are fitted into inside of the upper part of the hollow portions 18 and 19. As shown in FIG. 14 according to the sixth embodiment, an iron head 10E may be provided with recess portions 18E (not shown) and 19E being larger than the hollow portions 18 and 19 and disposed at the upper surface 16*b* of the protruding portion. The recess portions 18E and 19E face the hollow portions 18 and 19, and lids 23E (not shown) and 24E may be fixed into the recess portions 18E and 19E. Other configurations are the same as the first embodiment, and the same reference numerals denote the same components.

Seventh Embodiment

Figure 15:
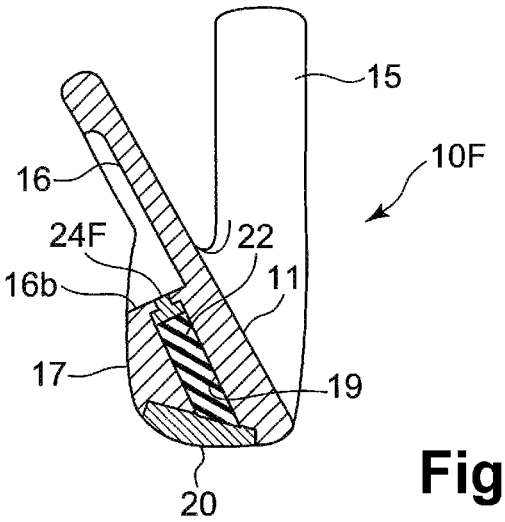
FIG. 15 is a sectional view of an iron head according to a seventh embodiment of the present invention.
Figure 16:
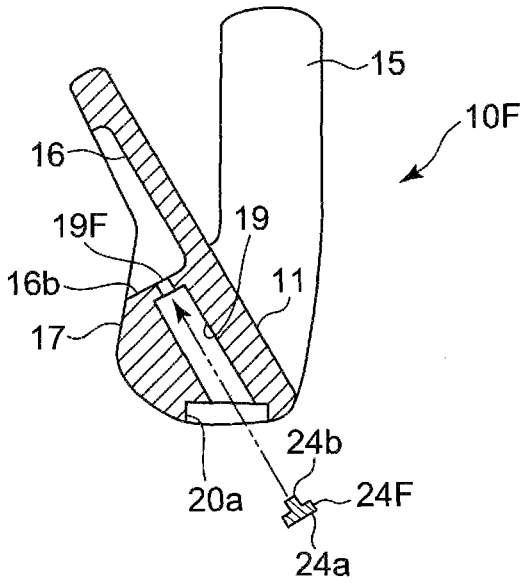
FIG. 16 is an exploded sectional view of the iron head shown in FIG. 15.

In the fifth and the sixth embodiments, the lids are attached to the upper end of the hollow portions from above. As shown in FIGS. 15 and 16, in an iron head 10F according to the seventh embodiment, lids 23F (not shown) and 24F are attached from below the hollow portions 18 and 19. The upper ends of the hollow portions 18 and 19 are connected to the cavity portion 16 through small holes 18F (not shown) and 19F. A lid 24F is provided with a board-shaped main part 24*a* and a projection portion 24*b* projecting from the top surface thereof. The projection portion 24*b* is inserted into a small hole 19. Although it is not shown, the lid 23F, to be attached to the hollow portion 18, has the same constitution. Other configurations in FIGS. 15 and 16 are same as in the first embodiment, and same reference numerals denote same components.

Eighth Embodiment

Figure 17:
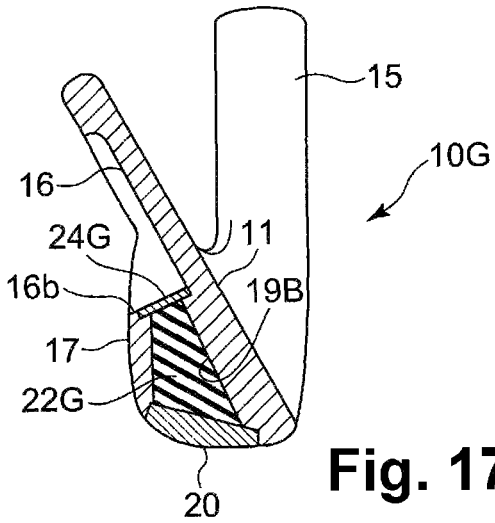
FIG. 17 is a sectional view of an iron head according to an eighth embodiment of the present invention.

As shown in FIG. 17, according to an eighth embodiment, in the iron head 10B in FIG. 9, an iron head 10G is provided with shock absorbers 21G (not shown) and 22G inserted into the hollow portions 18B (not shown) and 19B respectively. Further, the iron head 10G is provided with lids 23G (not shown) and 24G at the upper ends of the hollow portions 18B (not shown) and 19B. The upper surface 16*b* of the protruding portion is provided with recess portions (not shown) similar to the hollow portions 18E (not shown) and 19E shown in FIG. 14. The lids 23G and 24G are fitted and fixed into the recess portions. Other configurations in FIG. 17 are same as the embodiment shown in FIG. 9, and the same reference numerals denote same components.

Ninth Embodiment

Figure 18:
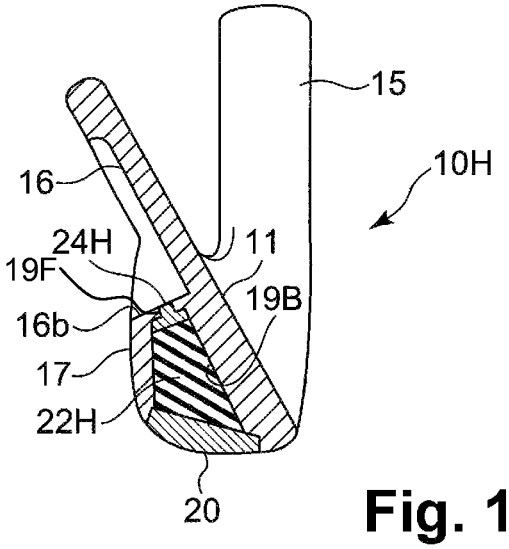
FIG. 18 is a sectional view of an iron head according to a ninth embodiment of the present invention.

As shown in FIG. 18, according to the ninth embodiment, an iron head 10H is provided with lids 23H (not shown) and 24H, instead of the lids 23G and 24G in the iron head 10G shown in FIG. 17. The lids 23H and 24H have a substantially same shape as that of the lid 24F shown in FIGS. 15 and 16. Similar to FIGS. 15 and 16, the small holes 18F (not shown) and 19F are provided at the upper end of the hollow portions 18B (not shown) and 19B. The projection portions disposed on the lids 23H and 24H are inserted into the small holes 18F and 19F. Other configurations in FIG. 18 are same as the embodiment shown in FIG. 9, and same reference numerals denote same components.

Tenth Embodiment

Figure 19:
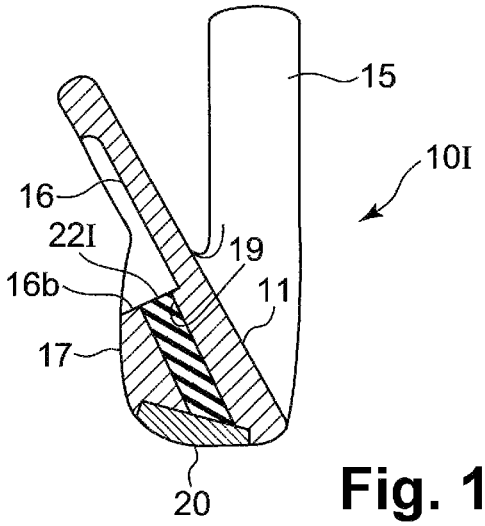
FIG. 19 is a sectional view of an iron head according to a tenth embodiment of the present invention.

As shown in FIG. 19, according to a tenth embodiment, in the iron head 10 shown in FIGS. 1 to 6, similar to FIGS. 11 to 13, an iron head 10I includes shock absorbers 21J (not shown) and 22J inserted into the hollow portions 18 (not shown in FIG. 19) and 19, respectively. Unlike the iron head 10D in FIGS. 11 to 13, the lid 23 is not installed at the upper end of the hollow portions 18 and 19. The upper surfaces of shock absorbers 21J and 22J are exposed to the cavity portion 16 and leveled with the upper surface 16*b* of the protruding portion. Other configurations are same as the first embodiment, and same reference numerals denote same components.

Eleventh Embodiment

Figure 20:
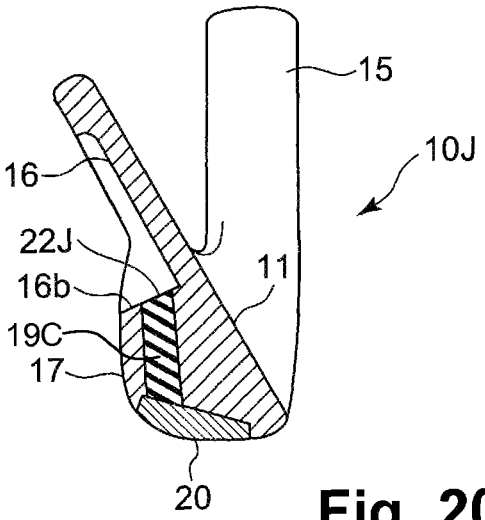
FIG. 20 is a sectional view of an iron head according to an eleventh embodiment of the present invention.

As shown in FIG. 20, according to an eleventh embodiment, in the iron head 10C in FIG. 10, an iron head 10J is provided with the shock absorbers 21J (not shown) and 22J inserted into the hollow portions 18C (not shown) and 19C, respectively. No lid is installed at the upper end of the hollow portions 18C and the 19C, and the upper surface of the shock absorbers 21J and 22J are leveled with the upper surface 16*b* of the protruding portion. Other configurations are same as the embodiment shown in FIG. 10, and same reference numerals denote same components.

Twelfth Embodiment

Figure 21:
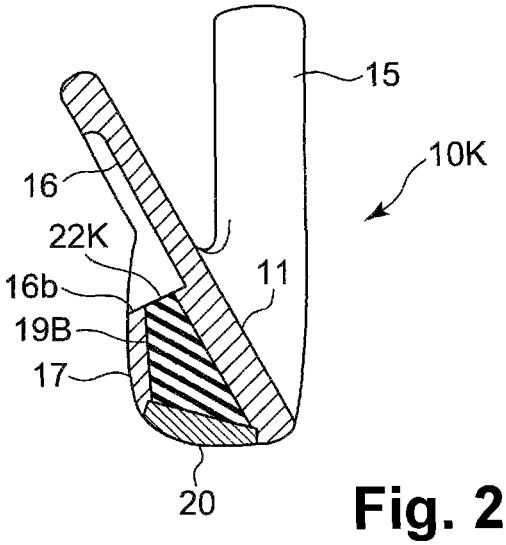
FIG. 21 is a sectional view of an iron head according to a twelfth embodiment of the present invention.

As shown in FIG. 21, according to a twelfth embodiment, in the iron head 10B in FIG. 9, an iron head 10K is provided with shock absorbers 21K (not shown) and 22K inserted into the hollow portions 18B (not shown) and 19B. No lid is installed at the upper end of the hollow portions 18B and 19B, and the upper surface of the shock absorbers 21K and 22K is leveled with the upper surface 16*b* of the protruding portion. Other configurations are same as the embodiment shown in FIG. 10, and same reference numerals denote same components.

Thirteenth Embodiment

Figure 22:
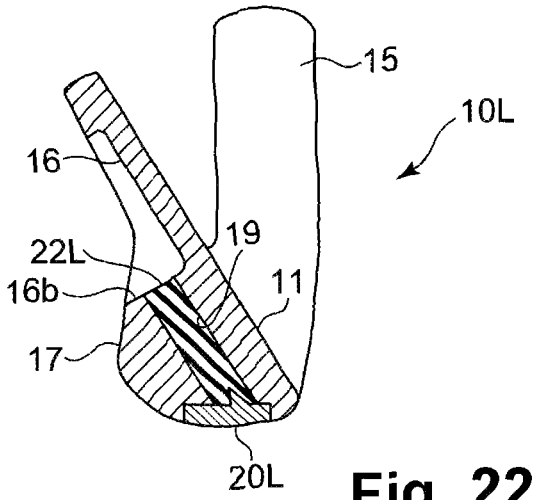
FIG. 22 is a sectional view of an iron head according to a thirteenth embodiment of the present invention.
Figure 23:
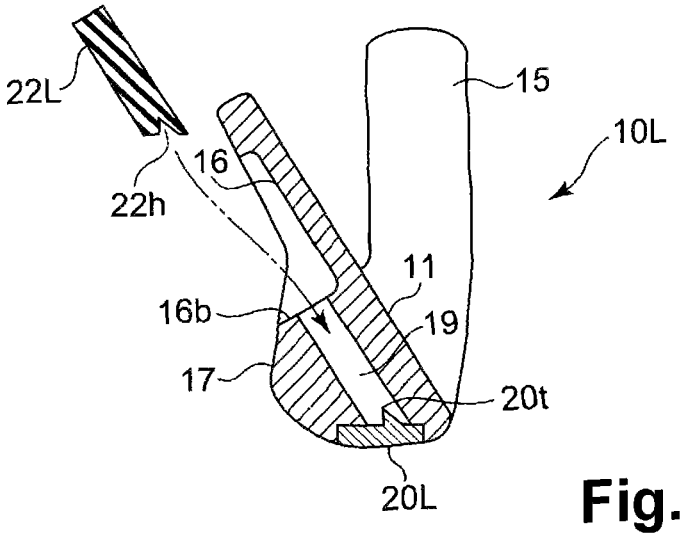
FIG. 23 is an exploded sectional view of the iron head according to the thirteenth embodiment of the present invention.

As shown in FIGS. 22 and 23, according to a thirteenth embodiment, instead of the bottom lid 20 in the iron head 10I in FIG. 19, an iron head 10L is provided with a bottom lid 20L having a wedge-shaped projection portion 20*t*. Further, instead of the shock absorber 22I, the iron head 10L is provided with a shock absorber 22L having a V-shaped ditch 22*h* at the bottom surface thereof. The shock absorber 22L is inserted into the hollow portion 19 from above. A width of the ditch 22*h* is smaller than a thickness of the wedge-shaped projection portion 20*t*.

When the shock absorber 22L is pushed into the hollow portion 19 from above, the projection portion 20*t* is pushed into the ditch 22*h*. Then, the bottom end of shock absorber 22L is extended by a force and pushed to the inside wall of the hollow portion 19 whose lower side is wider than the upper part thereof. Therefore, the shock absorber 22L is prevented from falling out from the hollow portion 19.

Although it is not shown, the bottom lid 20L is also provided with a projection portion, similar to the projection portion 20*t*, disposed at a point facing the hollow portion 18. Further, the shock absorber inserted into the hollow portion 18 is provided with a ditch, similar to the ditch 22*h*, disposed at the bottom surface of thereof. The projection portion and the ditch make it possible to prevent the shock absorber from falling out from the hollow portion 18.

Fourteenth Embodiment

Figure 24:
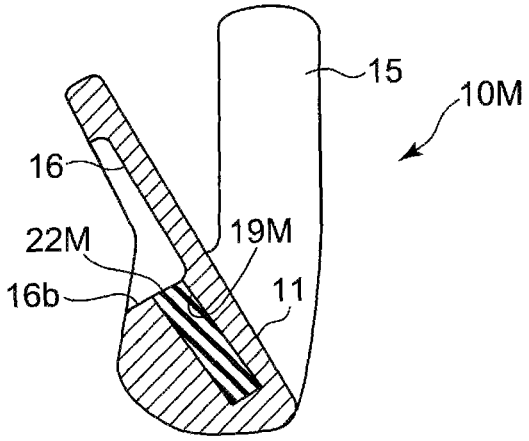
FIG. 24 is a sectional view of an iron head according to a fourteenth embodiment of the present invention.
Figure 25:
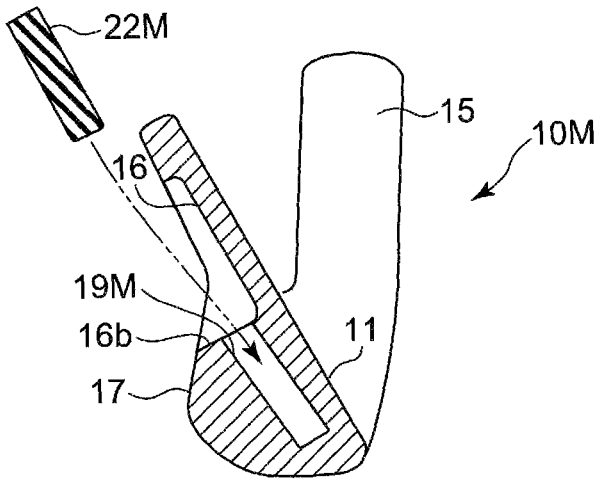
FIG. 25 is an exploded sectional view of the iron head according to the fourteenth embodiment of the present invention.

As shown in FIGS. 24 and 25, according to a fourteenth embodiment, an iron head 10M is provided with hollow portions 18M (not shown) and 19M extending from the upper surface 16*b* of the protruding portion toward the sole surface 14 but not reaching it. The hollow portions 18M and 19M are filled with shock absorbers 21M (not shown) and 22M. A shape and a size of the hollow portions 18M and 19M are substantially same as those of the hollow portions 18 and 19 in the first embodiment. No lid is installed at the upper end of the hollow portions 18M and 19M, and the shock absorbers 21M and 22M has an upper surface being leveled with the upper surface 16*b* of the protruding portion.

When the shock absorbers 21M and 22M are pushed into the hollow portions 18M and 19M, the shock absorbers 21M and 22M are fixed to the inside of the hollow portions 18M and 19M by adhesives added onto the outside wall of the shock absorbers 21M and 22M or the inside wall of the hollow portions 18M and 19M, in order to prevent the shock absorbers 21M and 22M from falling out from the hollow portions 18M and 19M.

The shock absorbers 21M and 22M have a rounded edge at the bottom end thereof. This is to prevent the edge of the shock absorbers 21M and 22M from being pushed to the corner of the hollow portions 18M and 19M and creating a strong stress at a certain limited area.

Fifteenth Embodiment

Figure 26:
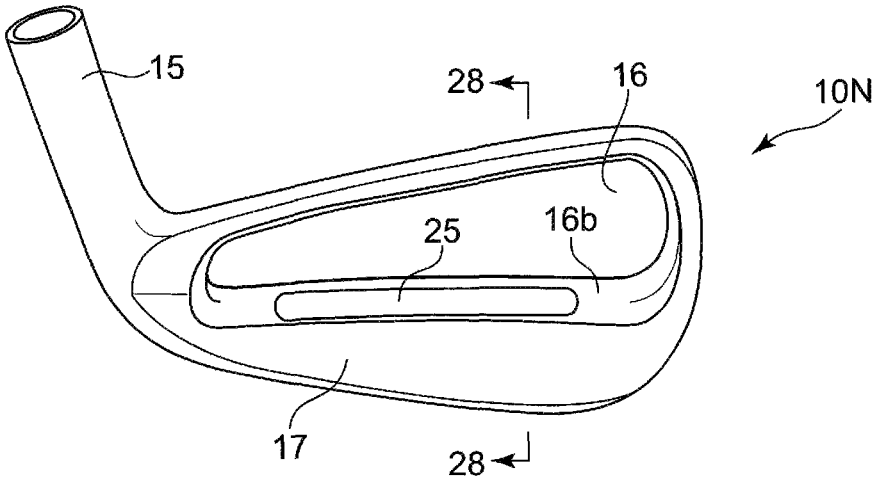
FIG. 26 is a rear view of an iron head according to a fifteenth embodiment of the present invention.
Figure 27:
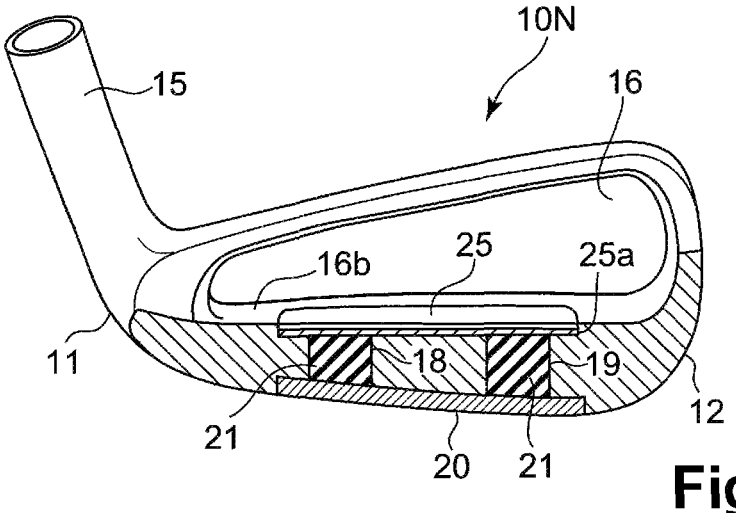
FIG. 27 is a sectional view of the iron head taken along a line 27-27 in FIG. 28 according to the fifteenth embodiment of the present invention.
Figure 28:
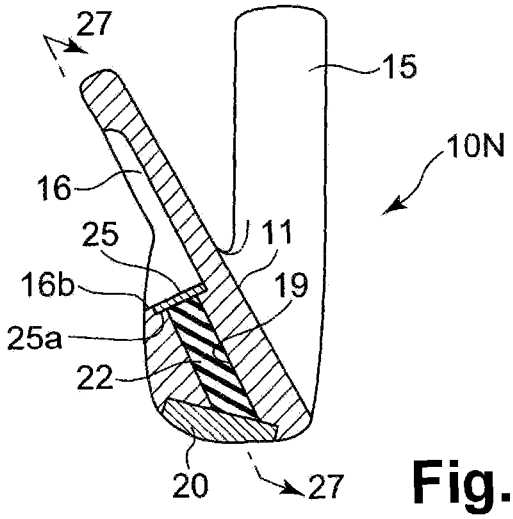
FIG. 28 is a sectional view of the iron head taken along a line 28-28 in FIG. 26 according to the fifteenth embodiment of the present invention.
Figure 29:
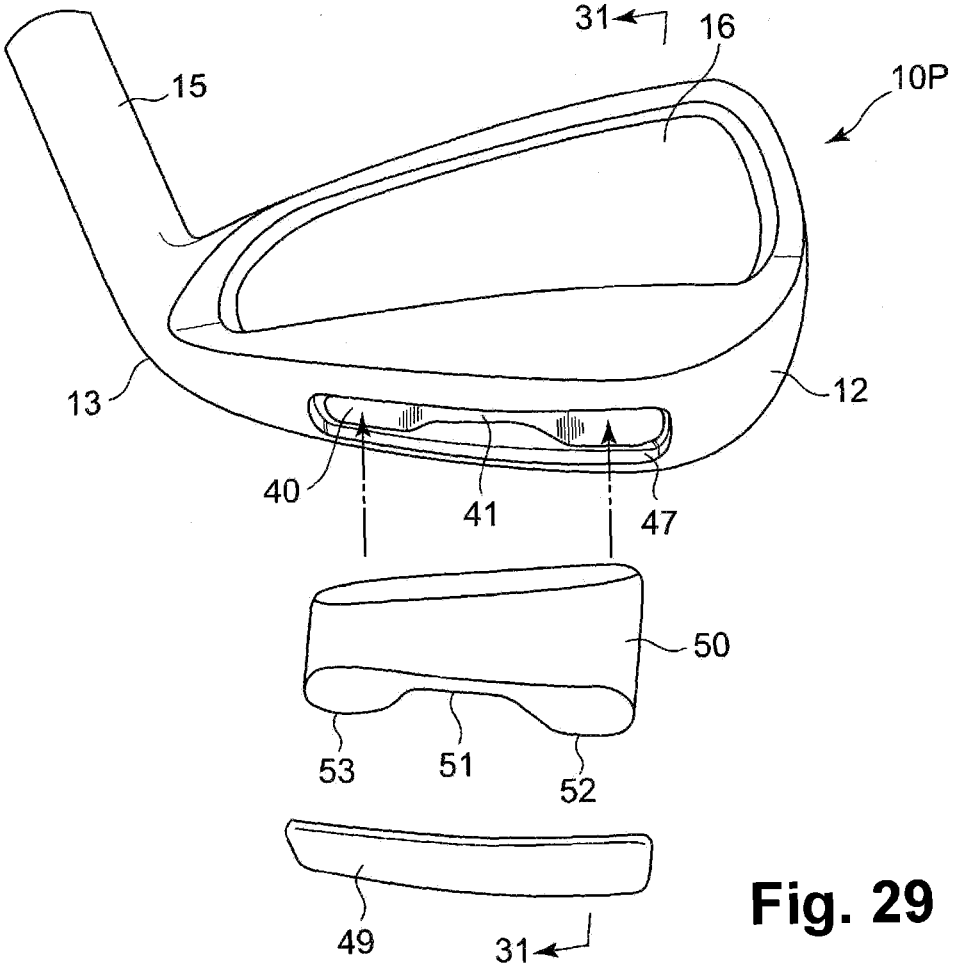
FIG. 29 is an exploded perspective view of an iron head according to a sixteenth embodiment of the present invention.
Figure 30:
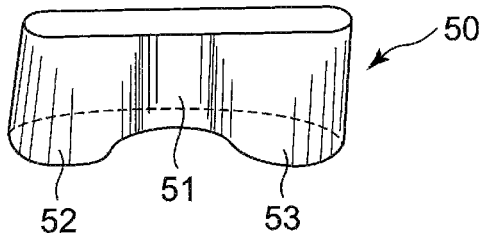
FIG. 30 is a perspective view of an elastic member according to the sixteenth embodiment of the present invention.
Figure 31:
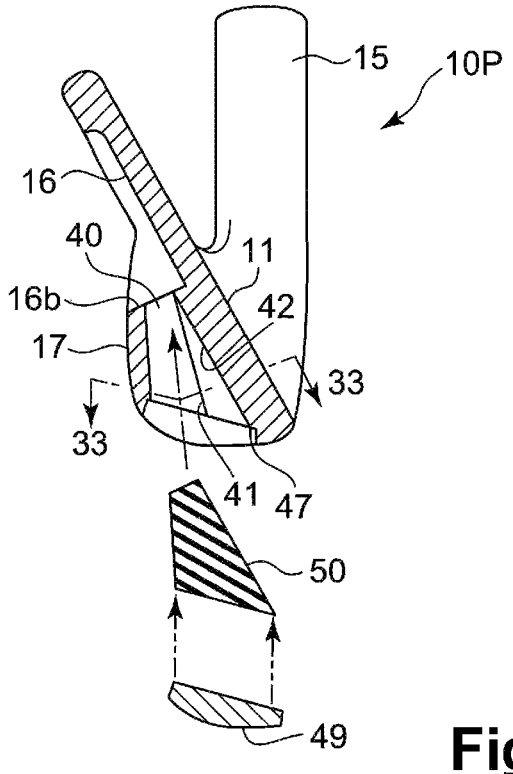
FIG. 31 is a sectional view of the iron head taken along a line 31-31 in FIG. 29 according to the sixteenth embodiment of the present invention.
Figure 32:
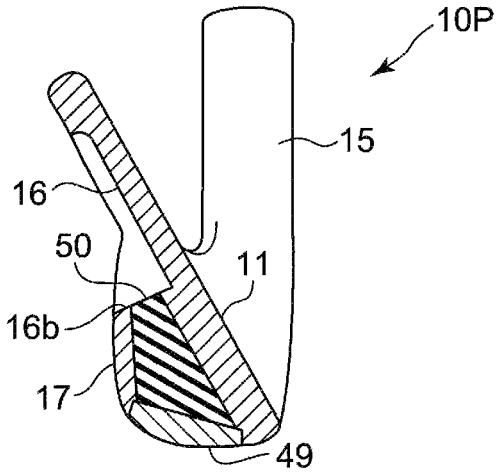
FIG. 32 is a sectional view of the iron head according to the sixteenth embodiment of the present invention.
Figure 33:
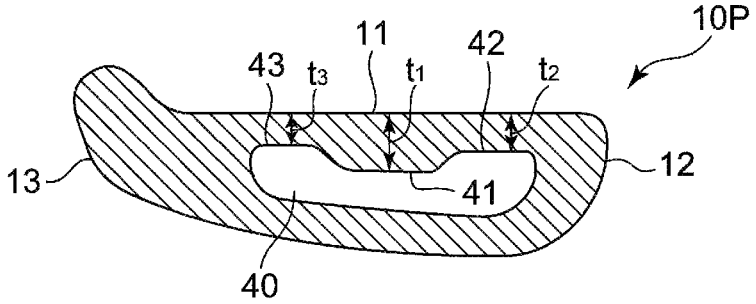
FIG. 33 is a sectional view of the iron head taken along a line 33-33 in FIG. 31 according to the sixteenth embodiment of the present invention.

As shown in FIGS. 26 to 28, according to the fifteenth embodiment, in the iron head 10D in the fifth embodiment, an iron head 10N is provided with a recess portion 25*a* extending from the hollow portion 18 to the hollow portion 19 at the upper surface 16*b* of the protruding portion. Further, a lid 25 is installed into the recess portion 25*a* and fixed by welding, caulking, shrink fitting, cooling fitting, and bonding. The lid 25 has an upper surface being leveled with the upper surface 16*b* of the protruding portion. Other configurations are same as in the fifth embodiment, and same reference numerals denote same components.

Sixteenth Embodiment

FIGS. 29 to 33 show an iron head 10P according to a sixteenth embodiment. Similar to the iron head 10, the iron head 10P is provided with the striking face 11 for hitting a ball, the toe side 12, the heel side 13, the sole surface 14, and the hosel 15 for connecting the shaft, the cavity portion 16 disposed at the upper portion of the backside surface, the protruding portion 17 projecting backward under the cavity portion 16. Further, the iron head 10P has a hollow portion 40 penetrating from the upper surface 16*b* of the protruding portion to the sole surface 14, a shock absorber 50 filled in the hollow portion 40, and a bottom lid 49 disposed at the sole surface for closing the hollow portion 40.

The hollow portion 40 extends from the proximity of the toe side 12 to the proximity of the heel side 13. A middle portion 41 of the hollow portion 40 on the sole side in a toe to heel direction is situated in the backside area of the sweet area of the striking face 11. The iron head 10P has a plurality of thicknesses t1, t2, and t3. The thickness t1 is a thickness of the middle portion 41 in a range between the hollow portion 40 and the striking face 11, i.e., the thickness of the face plate. The thickness t2 is a thickness of the face plate at a toe side part 42. The thickness t3 is a thickness of the face plate at a heel side part 43. The thickness t1 is larger than both a thickness t2 and the thickness t3.

It is desirable that a length of the hollow portion 40 in a toe to heel direction is 35 mm to 80 mm, especially 40 mm to 80 mm. A length of the middle portion 41 in a toe to heel direction is 15 mm to 40 mm, especially 18 mm to 35 mm. At the sole side end, it is desirable that the thickness t1 of the face plate is equal to or more than 2.5 mm, especially more than 5.0 mm. Further, it is desirable that the thickness t2 and the thickness t3 are 2.0 mm to 5.0 mm, especially 2.0 mm to 3.0 mm.

Around the upper surface 16*b* of the protruding portion, a width of the hollow portion 40 in the vertical direction to the striking face is substantially same as a distance from the toe side part 42 to the heel side part 43. In other words, at the upper part of the protruding portion 17, the thickness of the face plate is substantially same in a toe to heel direction.

The thicknesses t2 and t3 of the face plate at the toe side part 42 and the heel side part 43 of the hollow portion 40 are substantially same as those from the top to the bottom of the protruding portion 17. Also, the thicknesses t2 and t3 of the face plate at the lower portion of the protruding portion 17 may be slightly larger than the thicknesses t2 and t3 of the face plate at the upper portion of the protruding portion 17.

At the middle portion 41 of the hollow portion 40, the thickness t1 of the face plate increases gradually from the top to the sole side of the protruding portion 17.

A shock absorber 50 fits perfectly into the hollow portion 40 or has a size and a shape slightly larger than those of the hollow portion 40. A middle portion 51 of the shock absorber 50 in a toe to heel direction has a thickness being same as a thickness from a top to a bottom thereof in a front to back direction or in the direction to which a ball flies. At a toe side part 52 and a heel side part 53, a thickness of the shock absorber 50 is smallest at the top thereof and increases toward the bottom thereof.

The iron head 10P is provided a recess portion 47 for fixing the bottom lid 49 at the sole surface thereof. The bottom lid 49 is fitted and fixed into the recess portion 47. A method for fixing the bottom lid 49 includes welding, a laser welding for example; caulking; shrink fitting; and cooling fitting and bonding.

An upper surface of the shock absorber 50 is exposed to the cavity portion 16 and is leveled with the upper surface 16*b* of the protruding portion. A lid may be installed at the upper surface of the shock absorber 50.

According to the sixteenth embodiment, the iron head 10P is provided with the hollow portion 40 extending from the toe side to the heel side. With the hollow portion 40 being provided, it is possible to reduce the weight of the iron head. Therefore, it is possible to increase a size of the iron head without increasing the weight thereof. Further, when a weight distribution increases on the toe side 12 and the heel side 13 of the iron head, it is possible to increase the sweet area of the iron head without increasing the weight thereof. The iron head 10P has a plurality of thicknesses t1, t2, and t3. The thickness t1 is a thickness of a face plate at the rear side of the middle portion 41. The thickness t2 is a thickness of the face plate at the toe side 12. The thickness t3 is a thickness of the face plate at the heel side 13. Because the thickness t1 is larger than the thicknesses t2 and t3, the iron head 10P is capable of providing a strong impact feeling when hitting a ball.

The iron head 10P has a thickness of the face plate at the middle portion 41 being substantially same as the thickness of the face plate at the toe side part 42 and the heel side part 43 above the protruding portion 17. The thickness of the face plate at the middle portion 41 may be larger than that of the toe side part 42 and the heel side part 43. The iron head 10P has the hollow portion 40 filled with the shock absorber 50, and the shock absorber 50 may be omitted.

Seventeenth Embodiment

Figure 34:
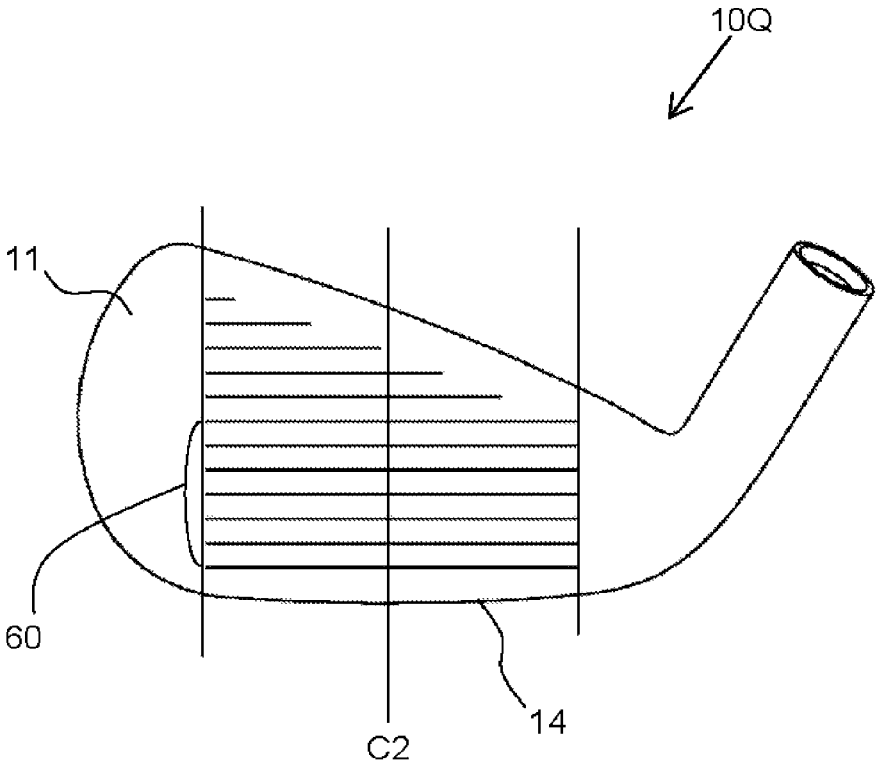
FIG. 34 is a front view of an iron head according to a seventeenth embodiment of the present invention.
Figure 35:
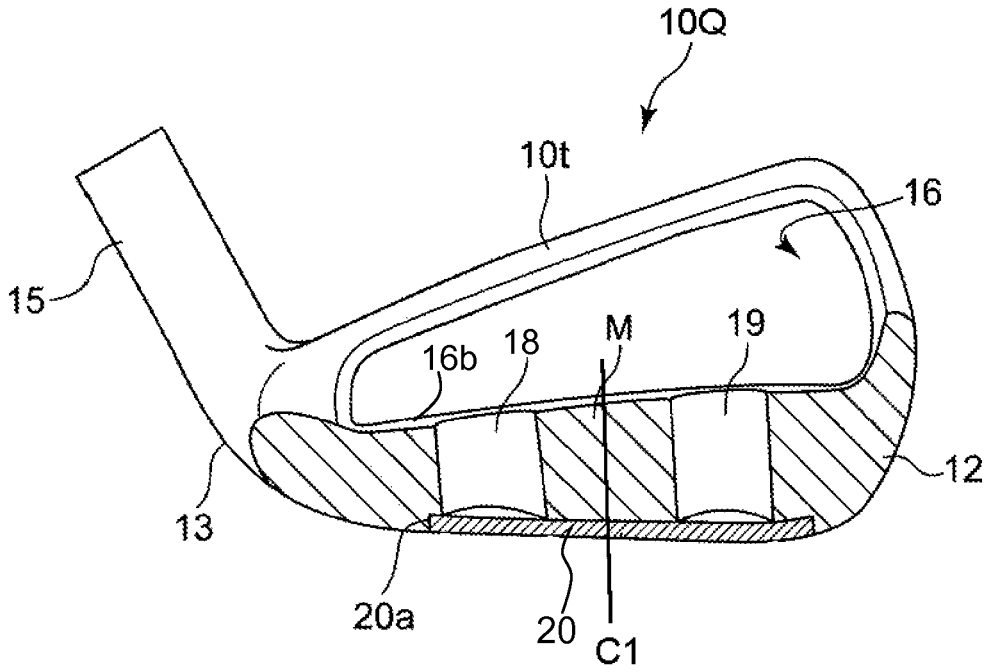
FIG. 35 is a sectional view of the iron head according to the seventeenth embodiment of the present invention.

FIGS. 34 and 35 show an iron head 10Q according to a seventeenth embodiment. FIG. 34 is a front view of the iron head 10Q according to the seventeenth embodiment. As shown in FIG. 34, the iron head 10Q is provided with a plurality of score lines formed on the face plate 11 thereof. The score lines consist of a plurality of lines extending in parallel with a certain distance therebetween equal to or more than 3 mm. A longest score line 60 is located near the sole surface 14.

FIG. 35 is a sectional view of the iron head 10Q according to the seventeenth embodiment. The iron head 10Q is provided with the striking face 11 for hitting a ball, the toe side 12, the heel side 13, the sole surface 14, and the hosel 15 for connecting the shaft. Further, the iron head 10Q has the cavity portion 16 disposed at the upper portion of the backside surface, the protruding portion 17 disposed at the lower portion of the backside surface and projected backward thereof, the first hollow portion 18 penetrating from the bottom surface 16*b* of the cavity portion 16 to the sole surface 14 and disposed at the heel side of the protruding portion 17, the second hollow portion 19 disposed at the toe side of the protruding potion 17, and the bottom lid 20 disposed at the sole surface and closing the first hollow portion 18 and the second the portion 19.

The middle portion M between the first hollow portion 18 and the second hollow portion 19 corresponds to a sweet area located at the lower central part of the striking face 11. The middle portion M is not a hollow but made of metal material, which is used to produce the iron head 10, such as iron and iron basis alloy.

In the iron head 10Q, the middle portion M is located so that a centerline C1 (cf. FIG. 35) of the middle part M is aligned with a centerline C2 (cf. FIG. 34) of the longest score line 60. With such a configuration provided, it is possible to align the centerline C1 of the middle portion M with the hitting point regardless of the distance between the first hollow portion 18 and the second hollow portion 19.

Eighteenth Embodiment

An eighteenth embodiment will be explained next with reference to FIGS. 36 to 39.

Figure 36:
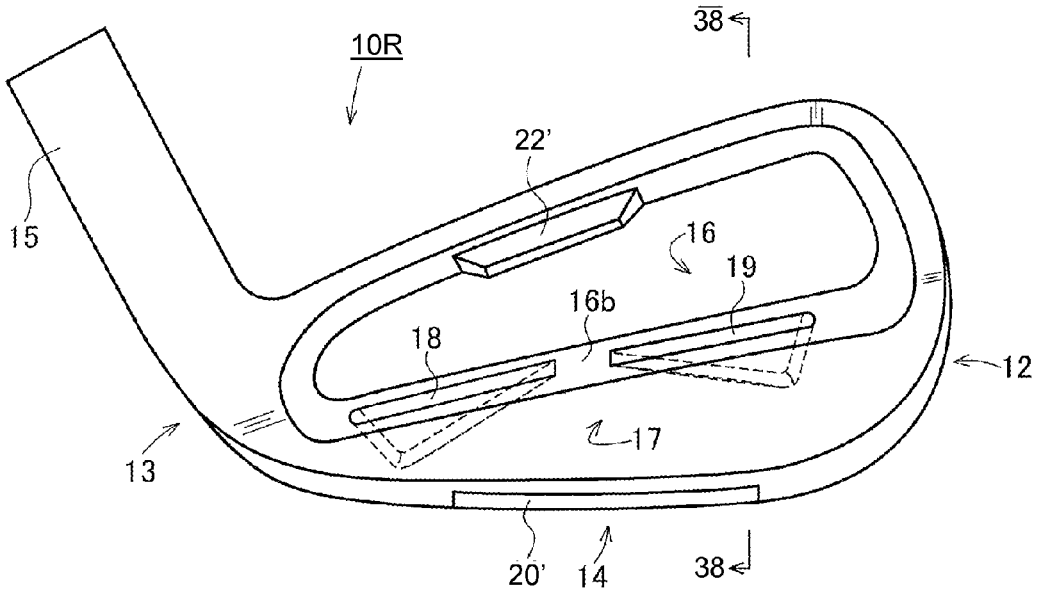
FIG. 36 is a rear view of the iron head according to an eighteenth embodiment of the present invention.
Figure 37:
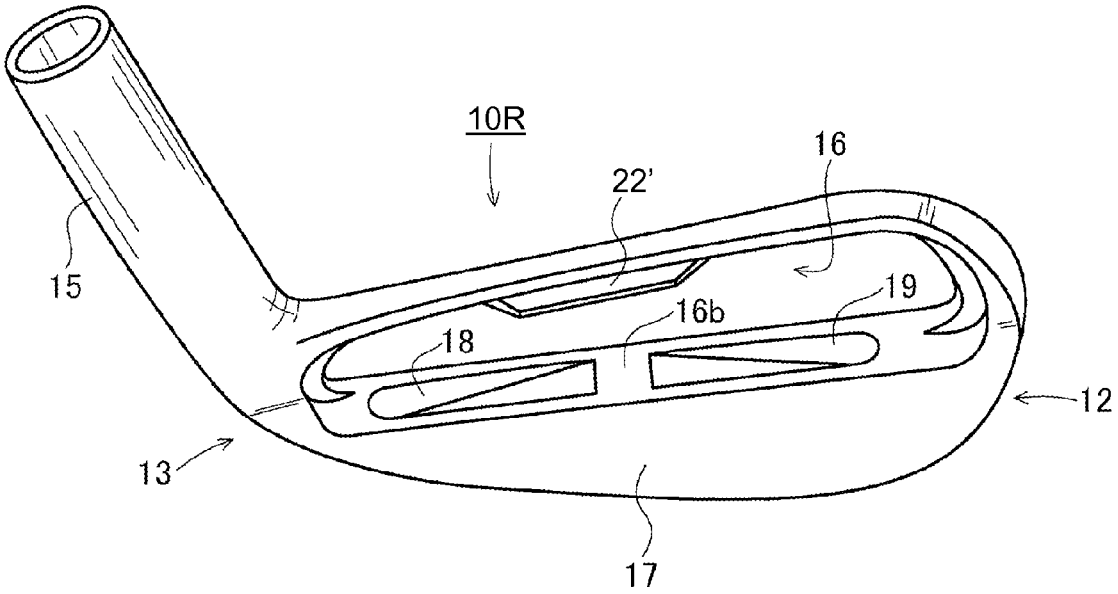
FIG. 37 is a perspective view of the iron head viewed from a rear upper direction according to the eighteenth embodiment of the present invention.

According to the eighteenth embodiment of the present invention, as shown in FIG. 36, an iron head 10R includes a striking face 11 for hitting a ball, a toe side 12, a heel side 13, a sole surface 14, and a hosel 15 for connecting a shaft. Further, the iron head 10R includes a cavity portion 16 disposed in an upper portion of a backside surface thereof and a protruding portion 17 disposed at a lower portion of the backside surface thereof and projecting backward. The iron head 10R further includes a first hollow portion 18 and a second hollow portion 19 disposed on the heel side 13 and the toe side 12 of the protruding portion 17 respectively, so as to hollow from an upper surface 16*b* of the protruding portion 17 toward the sole surface 14. Further, the iron head 10R includes a weight 20' disposed on the sole surface 14.

In the eighteenth embodiment, the cavity portion 16 is situated extending from the upper surface 16*b* to a neighborhood of an upper edge of the iron head 10R. It is preferable that a distance between the upper edge of the iron head 10R and an upper edge of the cavity portion 16 (H2−(H1+H3) in FIG. 38) is set between 3 mm and 12 mm, especially between 3 mm and 7 mm. The cavity portion 16 is situated extending from the toe side 12 to the heel side 13. It is preferable that a thickness of a face plate at the cavity portion 16 is set between 1.5 mm and 3.5 mm, especially between 2 mm and 3 mm.

Figure 38:
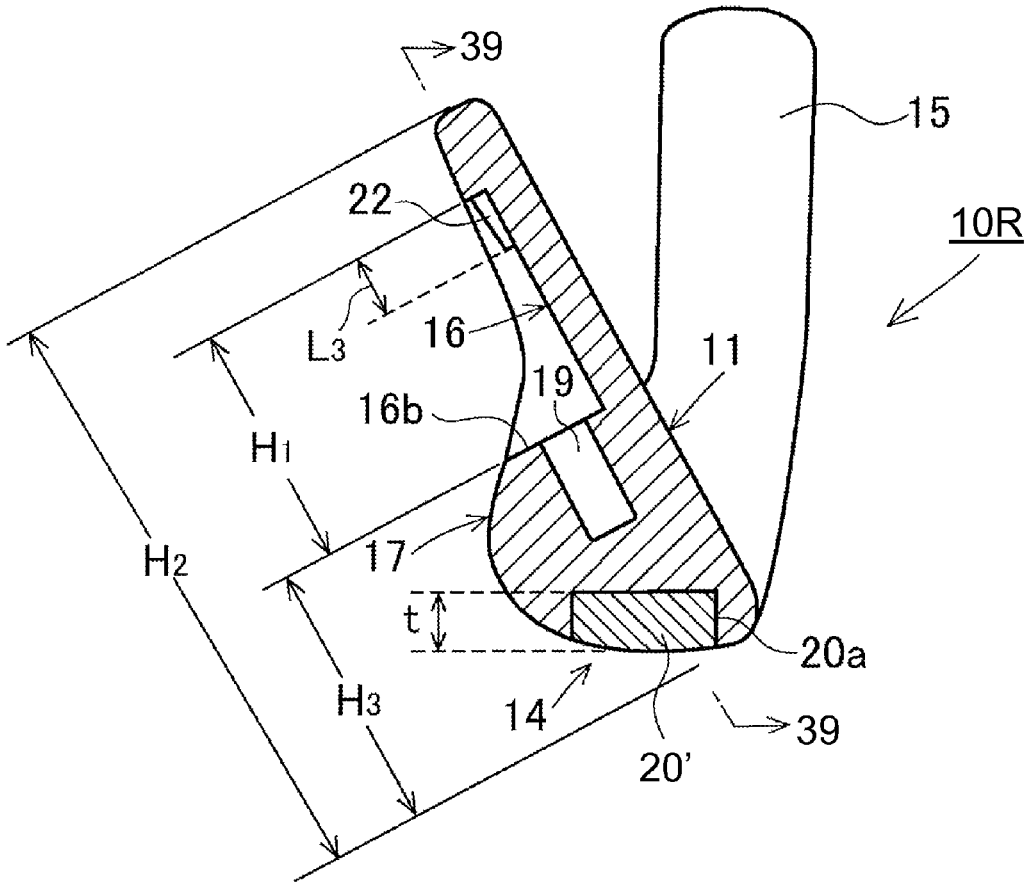
FIG. 38 is a sectional view of the iron head taken along a line 38-38 in FIG. 36 according to the eighteenth embodiment of the present invention.

In addition, as shown in FIG. 38, it is preferable that a maximum length H1 between a top and a bottom of the cavity portion 16 at proximity of the toe side 12 in a direction parallel with the striking face 11 is set between 20% and 50%, especially between 25% and 40% of a maximum length H2 between a top and a bottom of the striking face 11.

In the eighteenth embodiment, the protruding portion 17 projects backward at a lower side of the cavity portion 16. The upper surface 16*b* of the protruding portion 17 is substantially perpendicular to the striking face 11.

As shown in FIG. 38, it is preferable that a maximum length H3 from a top to a bottom of the protruding portion 17 at the proximity of the toe side 12 in the direction parallel with the striking face 11 is set between 48% and 78%, especially between 58% and 73%, of the maximum length H2 from the top to the bottom of the striking face 11. The same ratios among H1, H2 and H3 are preferably applied at proximity of the heel side 13, respectively.

In the eighteenth embodiment, the first hollow portion 18 and the second hollow portion 19 penetrate from the upper surface 16*b* of the protruding portion 17 toward the sole surface 14. The first hollow portion 18 and the second hollow portion 19 are situated so as to be symmetrical about a midpoint of the upper surface 16*b* in a direction from the toe side 12 to the heel side 13. The upper surface 16*b* is configured so as to be smooth. Depths of the first hollow portion 18 and the second hollow portion 19 become deeper as being apart from the midpoint. The first hollow portion 18 has the depth being deepest at proximity of the heel side 13 and the second hollow portion 19 has the depth being deepest at proximity of the toe side 12.

Figure 39:
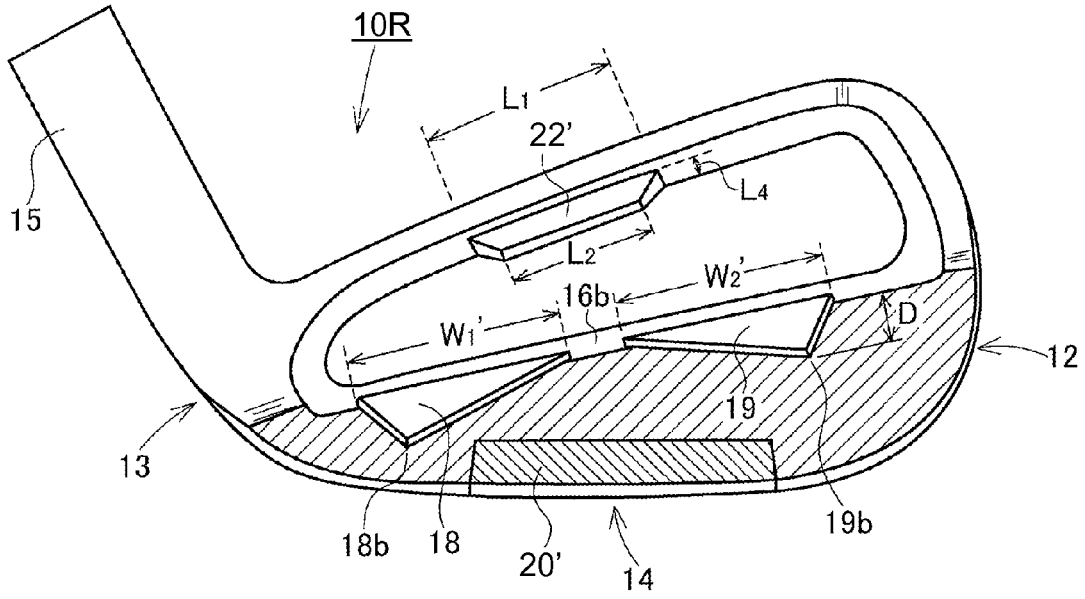
FIG. 39 is a sectional view of the iron head taken along a line 39-39 in FIG. 38 according to the eighteenth embodiment of the present invention.

As shown in FIG. 39, the first hollow portion 18 and the second hollow portion 19 have deepest points 18*b* and 19*b*, respectively. It is preferable that each of the deepest points 18*b* and 19*b* has a depth D being between 5 mm and 25 mm, especially between 10 mm and 20 mm from the upper surface 16*b*. It is preferable that a distance between the deepest point 18*b* of the first hollow portion 18 and the deepest point 19*b* of the second hollow portion 19 is set between 15 mm and 60 mm, especially between 40 mm and 60 mm. The first hollow portion 18 and the second hollow portion 19 have general triangle shapes, respectively. Further, the first hollow portion 18 and the second hollow portion 19 face each other with the acutest apexes of each of the triangle shapes thereof. In addition, each of the triangle shapes of the first hollow portion 18 and the second hollow portion 19 has the largest angle at the apex situated closest to the sole surface 14.

In the eighteenth embodiment, the first hollow portion 18 and the second hollow portion 19 have widths W1' and W2' in the direction from the toe side 12 to the heel side 13, respectively. It is preferable that each of the widths w1' and W2' is set between 10 mm and 20 mm, especially between 15 mm and 20 mm. Either of the hollow portions 18 and 19 is not situated at proximity of the midpoint of the upper surface 16*b* of the protruding portion 17 in the direction from the toe side 12 to the heel side 13. Therefore, the hollow portions 18 and 19 are separated from each other on the upper surface 16*b* of the protruding portion 17 by a predetermined distance. It is preferable that the predetermined distance, in other words, a distance between an end portion situated at the toe side 12 of the first hollow portion 18 and an end portion situated at the heel side 13 of the second hollow portion 19 on the upper surface 16*b* of the protruding portion 17, is set 15 mm and less, especially 10 mm and less.

In the eighteenth embodiment, stainless steel such as SUS630, 303 and 304; low-carbon steel such as S20C, S15C, and S25C; and maraging steel are shown as examples of iron or iron-base alloy used for producing the iron head 10R. Specific gravities of these materials are about 7.8 to 8.2. The iron head may be produced by either forging or casting.

In the eighteenth embodiment, the weight 20' may be made from a material having relatively larger specific gravities which are about 10 to 15, such as tungsten and tungsten alloy. The weight 20' is forcibly inserted into a recessed portion provided on the sole surface 14. It is preferable that the weight 20' has a length which is between 5 mm and 50 mm in the direction from the toe side 12 to the heel side 13, especially between 20 mm and 40 mm.

Further, as shown in FIG. 38, it is preferable that the weight 20' has a thickness t of 5 mm to 20 mm, especially from 5 mm to 10 mm. Further, it is preferable that the weight 20' has a width of 5 mm to 20 mm in a direction of a target line, especially from 10 mm to 20 mm.

In the eighteenth embodiment, a rib portion 22' is provided in a middle region in the direction from the toe side 12 to the heel side 13 of the upper edge of the cavity portion 16. The rib portion 22' extends along a circumferential surface of the upper edge of the cavity portion 16 in the direction from the toe side 12 to the heel side 13.

As shown in FIG. 39, it is preferable that the rib portion 22' has a length L1 at an upper side thereof being between 10 mm and 43 mm along the upper edge of the iron head 10R, especially between 15 mm and 30 mm.

Also, as shown in FIG. 39, the rib portion 22' has a length L2 at a lower side thereof. It is preferable that the length L2 is set between 50% and 100%, especially between 70% and 80% of the length L1. Further, as shown in FIG. 38, the rib portion 22' has a width L3 in the vertical direction. It is preferable that the width L3 is set between 2 mm and 10 mm, especially between 3 mm and 7 mm.

In addition, as shown in FIG. 39, the rib portion 22' has a thickness L4 at the upper side thereof. It is preferable that the thickness L4 is set between 0.5 mm and 4 mm, especially between 1 mm and 2 mm. It is preferable that the rib portion 22' becomes thinner toward a direction from the upper side to the lower side thereof. It is preferable that the rib portion 22' has a thickness at the lower side thereof, being from 30% to 80%, especially from 50% to 70% of the thickness L4.

In the eighteenth embodiment, the iron head 10R thus configured includes the first hollow portion 18 and the second hollow portion 19 disposed on the heel side 13 and the toe side of the protruding portion 17 respectively. Therefore, it is possible to reduce weight of the iron head 10R as much as the hollow portions 18 and 19. Accordingly, it is possible to increase the size of the iron head 10R without increasing the total weight thereof.

In addition, it is possible to increase the weight distribution on the toe side and the heel side of the iron head 10R without increasing the total weight thereof so that the sweet area of the iron head 10R is increased. The iron head 10R thus configured is capable of providing strong impact feeling when hitting the ball with the middle portion M, since the iron head 10R does not include the hollow portions 18 and 19 around a middle region between the toe side 12 and the heel side 13.

In the embodiment, the hollow portions 18 and 19 become shallower as being closer to the middle region between the toe side 12 and the heel side 13. Accordingly, the hollow portions 18 and 19 do not interfere with the weight 20'. Therefore, it is possible to design the iron head more freely, such as increasing the thickness t of the weight 20'.

In addition, in the embodiment, the iron head 10R includes the rib portion 22' in the middle region in the direction from the toe side 12 to the heel side 13 of the upper edge of the cavity portion 16. As a result, the iron head 10R is capable of obtaining higher rigidity around the upper edge of the cavity portion 16 thereof. Therefore, the iron head 10R is capable of providing better impact feeling since it is possible to control vibration upon hitting the ball.

Nineteenth Embodiment

A nineteenth embodiment of the present invention will be explained next with reference to FIG. 40.

According to the eighteenth embodiment of the present invention, the first hollow portion 18 and the second hollow portion 19 are situated apart from each other. According to the nineteenth embodiment of the present invention, as shown in FIG. 40, an iron head 10S may include a first hollow portion 18 contacting with an end portion in a heel side of a second hollow portion 19 at an end portion in a toe side thereof. In other words, a distance between the first hollow portion 18 and the second hollow portion 19 may be zero. According to the embodiment, the iron head 10S is capable of providing strong impact feeling when hitting a ball with the middle portion M.

Figure 40:
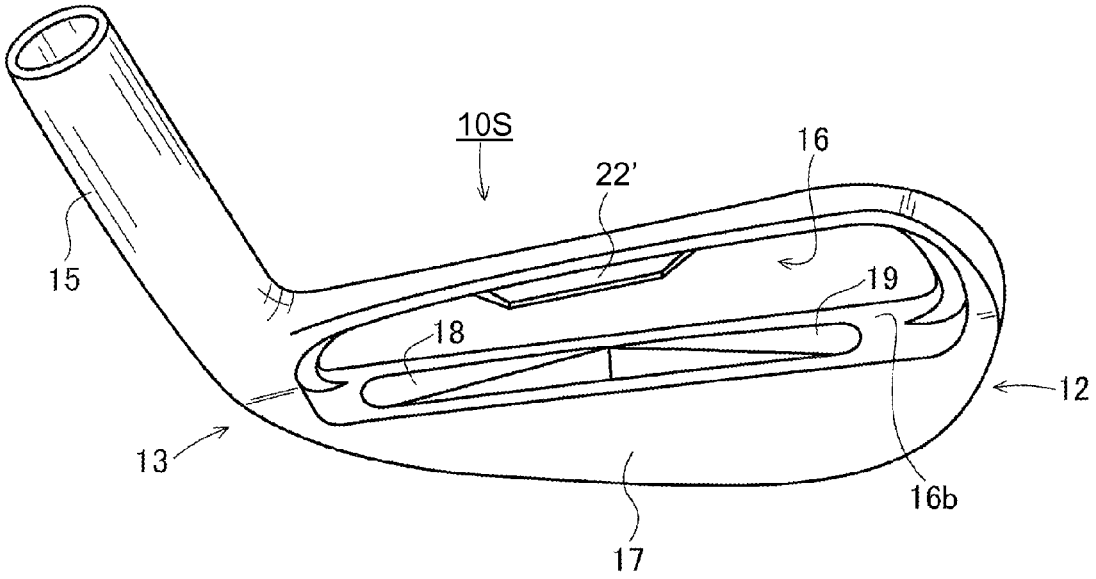
FIG. 40 is a rear view of the iron head according to a nineteenth embodiment of the present invention.

As shown in FIG. 40, other configurations of the iron head 10S are the same as the iron head 10R shown in FIGS. 36 to 39 and the same reference numerals denote same components.

Twentieth Embodiment

A twentieth embodiment of the present invention will be explained next with reference to FIG. 41.

Figure 41:
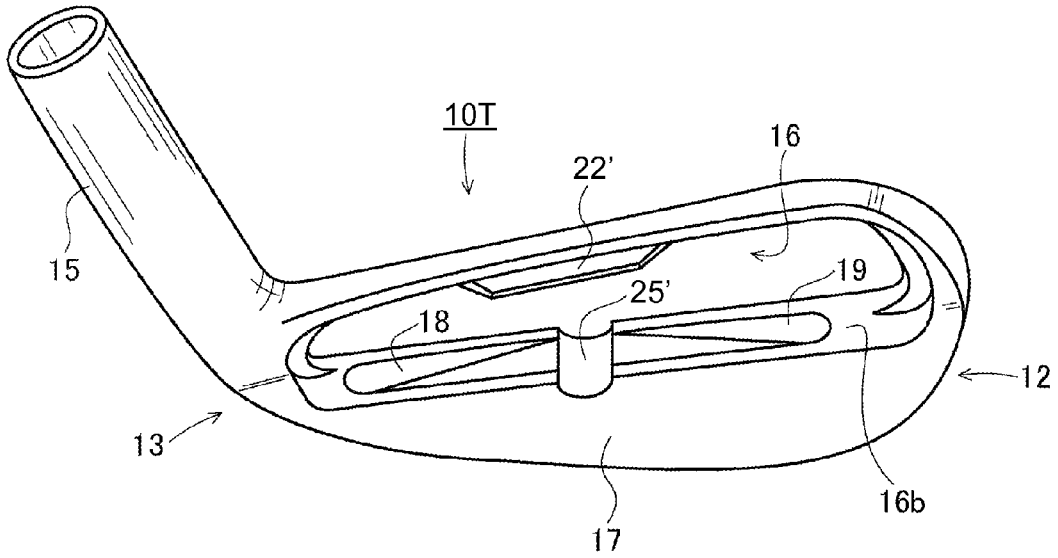
FIG. 41 is a rear view of the iron head according to a twentieth embodiment of the present invention.

According to the twentieth embodiment of the present invention, as shown in FIG. 41, an iron head 10T includes a first hollow portion 18 and a second hollow portion 19 which are situated apart from each other. In the embodiment, a concave portion 25' is provided between the first hollow portion 18 and the second hollow portion 19. In the embodiment, the concave portion 25' has a shape like a groove with an arch-shaped concave. The concave portion 25' may have a different shape, such as a rectangular groove. The concave portion 25' extends from a rear surface of a protruding portion 17 so as to reach a cavity portion 16. It is preferable that the concave portion 25' has a width being between 5 mm and 10 mm, especially between 8 mm and 12 mm, at an upper surface 16*b* of the protruding portion 17 in a direction from a toe side 12 to a heel side 13.

Further, it is preferable that the concave portion 25' has a depth being between 1 mm and 10 mm, especially between about 3 mm and 6 mm. Other configurations of the iron head 10T are the same as the iron head 10R shown in FIGS. 36 to 39 and the same reference numerals denote same components.

Twenty-first Embodiment

A twenty-first embodiment of the present invention will be explained next with reference to FIG. 42.

Figure 42:
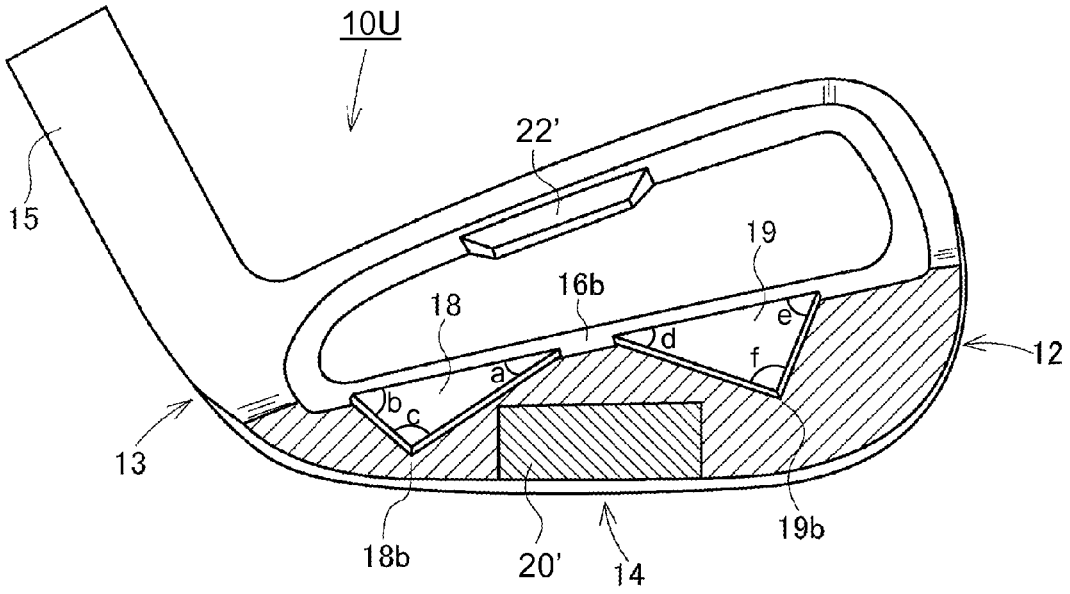
FIG. 42 is a rear view of the iron head according to a twenty first embodiment of the present invention.

According to the twenty-first embodiment of the present invention, as shown in FIG. 42, an iron head 10U includes a first hollow portion 18 and a second hollow portion 19 having deepest points 18*b* and 19*b* situated deeper than the deepest points 18*b* and 19*b* of the iron head 10R shown in FIGS. 36 to 39, respectively. Especially, the deepest point 19*b* on the toe side 12 is situated in deeper position than the deepest point 18. Further, the iron head 10U includes a weight 20' thicker than the weight 20' of the iron head 10R. Furthermore, an upper portion of the weight 20' is situated at an upper position than a line connecting the deepest point 18*b* of the first hollow portion 18 and the deepest point 19*b* of the second hollow portion 19. Other configurations of the iron head 10U are the same as the iron head 10R shown in FIGS. 36 to 39 and the same reference numerals denote same components.

In the embodiment, it is possible to lower the center of gravity of the iron head since the weight 20' having a specific gravity heavier than a main body of the iron head is provided between the hollow portions 18 and 19.

What is claimed is:

1. An iron head comprising:

a striking face;

a backside surface;

a sole surface;

a hosel;

a recess portion provided in an upper portion of the backside surface;

a protruding portion provided at a lower portion of the backside surface and projecting backward;

a first hollow portion provided on a heel side of the protruding portion; and a second hollow portion disposed on a toe side and inside the protruding portion, said protruding portion including a middle portion between the first hollow portion and the second hollow portion, wherein said first hollow portion is disposed away from the second hollow portion so that a distance between the first hollow portion and the second hollow portion in a direction from the heel side to the toe side gradually increases from an upper surface of the protruding portion toward the sole surface, and said cavity portion has a first maximum length in a vertical direction parallel with the striking face is set between 20% and 50% of a second maximum length of the striking face in the vertical direction.

2. The iron head according to claim 1, wherein at least one of said first hollow portion and said second hollow portion penetrates from an upper surface of the protruding portion to the sole surface, and has a first lid to close the sole surface.

3. The iron head according to claim 1, wherein at least one of said first hollow portion and said second hollow portion has a second lid to close an upper portion thereof.

4. The iron head according to claim 1, wherein said first hollow portion is disposed away from the second hollow portion by the distance of 10 to 30 mm at the upper surface of the protruding portion.

5. The iron head according to claim 1, wherein at least one of said first hollow portion and said second hollow portion is disposed not to reach the sole surface.

6. The iron head according to claim 1, wherein at least one of said first hollow portion and said second hollow portion is filled with a shock absorber.

7. The iron head according to claim 6, wherein said shock absorber is made of a rubber or an elastomer.

8. The iron head according to claim 1, wherein said striking face includes a plurality of score lines including a longest score line, said middle portion being disposed so that a center line of the middle portion is aligned with a center line of the longest score line.

9. The iron head according to claim 1, wherein said first hollow portion has a first length in a vertical direction, said second hollow portion having a second length in the vertical direction greater than the first length.

10. The iron head according to claim 1, wherein each of said first hollow portion and said second hollow portion has a substantially triangle shape.

11. The iron head according to claim 1, wherein each of said first hollow portion and said second hollow portion has a width between 10 mm and 20 mm at the upper surface of the protruding portion in the direction from the heel side to the toe side.

12. The iron head according to claim 1, further comprising a weight portion disposed in the protruding portion.

13. The iron head according to claim 12, wherein said weight is disposed between the first hollow portion and the second hollow portion in the direction from the heel side to the toe side.

14. The iron head according to claim 1, further comprising a rib portion disposed at an upper edge of the recess portion.

15. An iron head comprising:

a striking face;

a backside surface;

a sole surface;

a hosel;

a recess portion provided in an upper portion of the backside surface;

a protruding portion provided at a lower portion of the backside surface and projecting backward:

a first hollow portion provided on a heel side of the protruding portion; and a second hollow portion disposed on a toe side and inside the protruding portion, said protruding portion including a middle portion between the first hollow portion and the second hollow portion, wherein said first hollow portion is disposed away from the second hollow portion so that a distance between the first hollow portion and the second hollow portion in a direction from the heel side to the toe side gradually increases from an upper surface of the protruding portion toward the sole surface, and said protruding portion has a third maximum length in a vertical direction parallel with the striking face is set between 48% and 78% of a second maximum length of the striking face in the vertical direction.

16. The iron head according to claim 15, wherein said first hollow portion is disposed away from the second hollow portion by the distance of 10 to 30 mm at the upper surface of the protruding portion.

* * * * *